US010344777B2

(12) United States Patent
Tanaka et al.

(10) Patent No.: US 10,344,777 B2
(45) Date of Patent: Jul. 9, 2019

(54) EJECTOR WITH TEMPERATURE-SENSITIVE DRIVE DEVICE

(71) Applicant: DENSO CORPORATION, Kariya, Aichi-pref. (JP)

(72) Inventors: Eitaro Tanaka, Kariya (JP); Toru Takahashi, Kariya (JP); Satoshi Inoue, Kariya (JP); Haruyuki Nishijima, Kariya (JP); Etsuhisa Yamada, Kariya (JP); Yoichiro Kawamoto, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 647 days.

(21) Appl. No.: 14/908,587

(22) PCT Filed: Jul. 25, 2014

(86) PCT No.: PCT/JP2014/003925

§ 371 (c)(1),
(2) Date: Jan. 29, 2016

(87) PCT Pub. No.: WO2015/015782

PCT Pub. Date: Feb. 5, 2015

(65) Prior Publication Data

US 2016/0177974 A1 Jun. 23, 2016

(30) Foreign Application Priority Data

Aug. 1, 2013 (JP) ..... 2013-160510
Dec. 13, 2013 (JP) ..... 2013-258342

(51) Int. Cl.
*F04F 5/04* (2006.01)
*F04F 5/46* (2006.01)
(Continued)

(52) U.S. Cl.
CPC ..... *F04F 5/04* (2013.01); *F04F 5/16* (2013.01); *F04F 5/44* (2013.01); *F04F 5/46* (2013.01);
(Continued)

(58) Field of Classification Search
CPC ..... F04F 5/14; F04F 5/16; F04F 5/18; F04F 5/42; F04F 5/44; F04F 5/461; F04F 5/48; F04F 5/50; F04F 5/46
See application file for complete search history.

(56) References Cited

U.S. PATENT DOCUMENTS

2002/0000095 A1 1/2002 Takeuchi et al.
2004/0172966 A1* 9/2004 Ozaki ..... F04F 5/04 62/500
(Continued)

FOREIGN PATENT DOCUMENTS

JP 59123700 U 8/1984
JP 3331604 B2 10/2002
(Continued)

OTHER PUBLICATIONS

International Search Report and Written Opinion (in Japanese with English Translation) for PCT/JP2014/003925, dated Oct. 14, 2014; ISA/JP.

*Primary Examiner* — Bryan M Lettman
(74) *Attorney, Agent, or Firm* — Harness, Dickey & Pierce, P.L.C.

(57) ABSTRACT

In an ejector, formed in a body is a swirling space which lets a high-pressure refrigerant flowing from a refrigerant inlet port swirl and introduces the swirling high-pressure refrigerant into a depressurizing space in which the swirled high-pressure refrigerant is depressurized and expanded. A passage formation member that defines a nozzle passage and a diffuser passage is shaped to have a cross-sectional area increasing with distance from the depressurizing space.
(Continued)

Further, a temperature sensing unit of a drive device that displaces the passage formation member is housed in the body, and the temperature sensing unit and a diaphragm have annular shapes to surround at least the axial line of the passage formation member.

15 Claims, 15 Drawing Sheets

(51) Int. Cl.

| | |
|---|---|
| ***F04F 5/44*** | (2006.01) |
| ***F04F 5/48*** | (2006.01) |
| ***F25B 41/00*** | (2006.01) |
| ***F25B 41/06*** | (2006.01) |
| ***F04F 5/16*** | (2006.01) |
| *F25B 27/00* | (2006.01) |
| *F25B 40/02* | (2006.01) |

(52) U.S. Cl.
CPC ..... *F04F 5/48* (2013.01); *F25B 41/00* (2013.01); *F25B 41/062* (2013.01); *F25B 27/00* (2013.01); *F25B 40/02* (2013.01); *F25B 2327/001* (2013.01); *F25B 2341/0012* (2013.01); *F25B 2400/23* (2013.01); *F25B 2500/18* (2013.01)

(56) References Cited

U.S. PATENT DOCUMENTS

| | | | | |
|---|---|---|---|---|
| 2004/0255611 | A1 | 12/2004 | Nishijima et al. | |
| 2014/0134007 | A1* | 5/2014 | Koith ..... | B60K 15/035 417/191 |
| 2015/0033790 | A1 | 2/2015 | Yamada et al. | |
| 2015/0033791 | A1 | 2/2015 | Yamada et al. | |
| 2016/0186782 | A1 | 6/2016 | Nakashima et al. | |

FOREIGN PATENT DOCUMENTS

| | | | |
|---|---|---|---|
| JP | 2003014318 | A | 1/2003 |
| JP | 2003336915 | A | 11/2003 |
| JP | 2008134048 | A | 6/2008 |
| JP | 2009144607 | A | 7/2009 |
| JP | 2013177879 | A | 9/2013 |
| JP | 2013185484 | A | 9/2013 |
| WO | WO-2013114856 | A1 | 8/2013 |

* cited by examiner

EJECTOR WITH TEMPERATURE-SENSITIVE DRIVE DEVICE

CROSS REFERENCE TO RELATED APPLICATIONS

This application is a U.S. National Phase Application under 35 U.S.C. 371 of International Application No. PCT/JP2014/003925 filed on Jul. 25, 2014 and published in Japanese as WO 2015/015782 A1 on Feb. 5, 2015. This application is based on and claims the benefit of priority from Japanese Patent Applications No. 2013-160510 filed on Aug. 1, 2013, and No. 2013-258342 filed on Dec. 13, 2013. The entire disclosures of all of the above applications are incorporated herein by reference.

TECHNICAL FIELD

The present disclosure relates to an ejector that is a momentum transport pump that depressurizes a fluid and performs fluid transport by a suction action of a working fluid ejected at high speed.

BACKGROUND ART

Some of conventional ejectors disclosed in, for example, Patent Document 1 and Patent Document 2 have been known. The ejector of this type includes a nozzle portion that depressurizes a refrigerant condensed and liquefied by a refrigerant condenser after compressed to a high pressure by a compressor when the ejector is used in a refrigeration cycle, a suction portion that draws a lower pressure side refrigerant flowing out of a refrigerant evaporator, and a diffuser portion that mixes the refrigerant ejected from the nozzle portion with the refrigerant drawn from the suction portion and increases a pressure of the mixture.

Further, the nozzle portion of the ejector in Patent Document 1 includes a first nozzle that depressurizes and expands a liquid refrigerant which flows therein from the refrigerant condenser, and a second nozzle that again depressurizes and expands the refrigerant that has been put into two phases of gas-liquid by the first nozzle, and ejects the refrigerant. With the above configuration, the refrigerant is expanded into the two phases of gas-liquid by the first nozzle, and further depressurized and expanded by the second nozzle. As a result, an exit velocity of the refrigerant that flows out of the second nozzle can be increased, and nozzle efficiency can be improved.

In a general ejector, a diffuser portion (pressure increase part) is coaxially disposed on an extension line in an axial direction of a nozzle portion. In addition, Patent Document 2 discloses that a spread angle of the diffuser portion thus arranged is relatively reduced to enable an improvement in the ejector efficiency. The nozzle efficiency means an energy conversion efficiency when a pressure energy of the refrigerant is converted into a kinetic energy in the nozzle portion. The ejector efficiency means an energy conversion efficiency as the overall ejector.

However, in the ejector of Patent Document 1, when a refrigerant pressure difference between a high pressure side and a low pressure side is small, for example, when a load of the refrigeration cycle is low, most of the refrigerant pressure difference is depressurized by the first nozzle, and the refrigerant can be hardly depressurized in the second nozzle. As a result, in the low load of the refrigeration cycle, there arises such a problem that the refrigerant may not be sufficiently pressurized in the diffuser portion. In other words, in the ejector of Patent Document 1, the sufficient operation of the ejector which is commensurate with the load of the refrigeration cycle may not be obtained.

On the contrary, the following configuration is proposed. The diffuser portion having the relatively small spread angle disclosed in Patent Document 2 may be applied to the ejector of Patent Document 1, to thereby improve the ejector efficiency and pressurize the refrigerant sufficiently in the diffuser portion even in the low load of the refrigeration cycle.

However, when the diffuser portion disclosed in Patent Document 2 is applied to the ejector in Patent Document 1, a length of the nozzle portion in the axial direction becomes longer, and a body size of the ejector becomes unnecessarily larger in the normal load of the refrigeration cycle.

In the ejector of Patent Document 1, because each nozzle is configured by a fixed throttle, a flow rate of the refrigerant cannot be adjusted, and the ejector cannot be operated in correspondence with a load variation of the refrigeration cycle.

On the contrary, it is conceivable to add an adjustment mechanism for adjusting a throttle opening (flow channel area) of a throttle passage (nozzle passage) that depressurizes and expands a high-pressure refrigerant according to a temperature and a pressure of an evaporator outflow refrigerant such as a temperature type expansion valve.

The above adjustment mechanism includes a valve body for adjusting the throttle opening, a diaphragm that is displaced according to a difference between an internal pressure in a sealed space in which a temperature sensitive medium varied in pressure according to a temperature of the evaporator outflow refrigerant is sealed and the pressure of the evaporator outflow refrigerant, and an actuating bar for transmitting a displacement of the diaphragm.

However, a general thermal expansion valve is of a structure in which the actuating bar and the valve body are housed in a body configuring a shell of the thermal expansion valve, the sealed space and the diaphragm are disposed outside of the body, and a temperature of the temperature sensitive medium is likely to be affected by an external ambient temperature. When the temperature of the temperature sensitive medium is affected by the external ambient temperature, the valve body may be displaced regardless of the temperature of the evaporator outflow refrigerant, and the operation of the refrigeration cycle may become unstable.

For that reason, even if the adjustment mechanism employed in the thermal expansion valve is applied to the ejector, it is difficult to adjust the refrigerant flow rate according to the temperature and the pressure of the evaporator outflow refrigerant, which still makes it difficult to obtain the sufficient operation of the ejector commensurate with the load of the refrigeration cycle.

PRIOR ART DOCUMENT

Patent Document

Patent Document 1: JP 3331604
Patent Document 2: JP 2003-14318 A

SUMMARY OF THE INVENTION

In view of the above, it is an objective of the present disclosure is to provide an ejector capable of performing the operation commensurate with the load of the refrigeration cycle while restraining the body size from being upsized.

According to an aspect of the present disclosure, an ejector is used for a vapor compression refrigeration cycle. The ejector includes a body including a refrigerant inlet port through which a refrigerant is introduced, a swirling space in which the refrigerant flowing from the refrigerant inlet port is swirled, a depressurizing space in which the refrigerant flowing out of the swirling space is depressurized, a suction passage that communicates with a downstream side of the depressurizing space in a refrigerant flow and draws a refrigerant from an external, and a pressurizing space in which a refrigerant ejected from the depressurizing space and a refrigerant drawn through the suction passage are mixed with each other and pressurized. The ejector further includes a passage formation member which is arranged at least in the depressurizing space and the pressurizing space and has a shape that increases in cross-sectional area with distance from the depressurizing space, and a drive device that displaces the passage formation member. The depressurizing space has a nozzle passage, which functions as a nozzle that depressurizes and ejects the refrigerant that has flowed out of the swirling space, between an inner peripheral surface of the body and an outer peripheral surface of the passage formation member. The pressurizing space has a diffuser passage, which functions as a diffuser that mixes and pressurizes the ejection refrigerant and the suction refrigerant together, between the inner peripheral surface of the body and the outer peripheral surface of the passage formation member. The drive device includes a temperature sensing unit in which a temperature sensitive medium that changes in pressure according to temperature change is sealed, and a pressure responsive member that is displaced according to a pressure of the temperature sensitive medium in the temperature sensing unit. The drive device is housed in the body in a state where a heat of the suction refrigerant in the suction passage is transferred to the temperature sensitive medium in the temperature sensing unit through the temperature sensing unit. The temperature sensing unit and the pressure responsive member each have an annular shape surrounding an axial line of the passage formation member.

According to the above configuration, with the swirling of the refrigerant in the swirling space, the depressurization and boiling of the refrigerant in the nozzle passage is promoted, and the gas-liquid of the refrigerant can be homogeneously mixed together in the nozzle passage. This makes it possible to increase a flow rate of the ejection refrigerant from the nozzle passage, and to improve the nozzle efficiency in the nozzle passage.

In this situation, in the present disclosure, the refrigerant is depressurized and boiled by not two-stage nozzles but a single nozzle passage. For that reason, all of the pressure energy of the refrigerant flowing into the ejector is leveraged to enable a pressure increase energy to be obtained due to the diffuser passage, and the operation of the ejector commensurate with the load of the refrigeration cycle to be derived from the pressure increase energy.

Since the passage formation member is shaped to have the cross-sectional area increasing with distance from the depressurizing space, the diffuser passage can be shaped to spread along an outer periphery of the passage formation member with distance from the depressurizing space. As a result, an increase in a dimension of the nozzle portion in a direction corresponding to the axial direction is suppressed, and an increase in the body size as the whole ejector can be suppressed.

In addition, in the present disclosure, the drive device for driving the passage formation member is housed inside of the body that is not directly affected by the external ambient temperature. According to the configuration, an influence of the external ambient temperature on the temperature sensing unit in the drive device is suppressed, and the refrigerant passage areas of the nozzle passage and the diffuser passage cab be appropriately changed. Further, since the temperature sensing unit and the pressure responsive member of the drive device have an annular shape to surround the axial line of the passage formation member, an area that receives a pressure of the refrigerant in the pressure responsive member can be sufficiently ensured, and the refrigerant passage areas of the nozzle passage and the diffuser passage can be appropriately changed. As a result, the refrigerant flow rate corresponding to the load of the refrigeration cycle can flow, and the operation of the ejector commensurate with the load of the refrigeration cycle can be derived.

The temperature sensing unit and the pressure responsive member in the drive device are formed into the annular shape surrounding the axial line of the passage formation member to enable an internal space that does not interfere with the passage formation member in the body to be effectively leveraged as a space in which the drive device is installed. For that reason, the body size of the overall ejector can be further restrained from being upsized.

As described above, the present disclosure can provide the ejector capable of performing the operation commensurate with the load of the refrigeration cycle together with an improvement in the nozzle efficiency while restraining the body size from being upsized.

The passage formation member is not only strictly shaped to have the cross-sectional area increasing with distance from the depressurizing space, but also at least partially shaped to have the cross-sectional area increasing with distance from the depressurization space.

The plate member that is in contact with the pressure responsive member may be inclined in posture and come in contact with an inner wall surface of the body. The contact of the plate member with the inner wall surface of the body leads to an increase in a frictional force when the pressure responsive member is displaced, and therefore the displacement of the pressure responsive member may not be property transmitted to the passage formation member.

Under the circumstances, three or more actuating bars are arranged around the axial line of the passage formation member. According to the above structure, since the plate member is supported by the actuating bars at three or more points, and the posture of the plate member can be stabilized, a trouble caused by the inclination of the posture of the plate member can be restrained from occurring.

EMBODIMENTS FOR EXPLOITATION OF THE INVENTION

Figure 1:
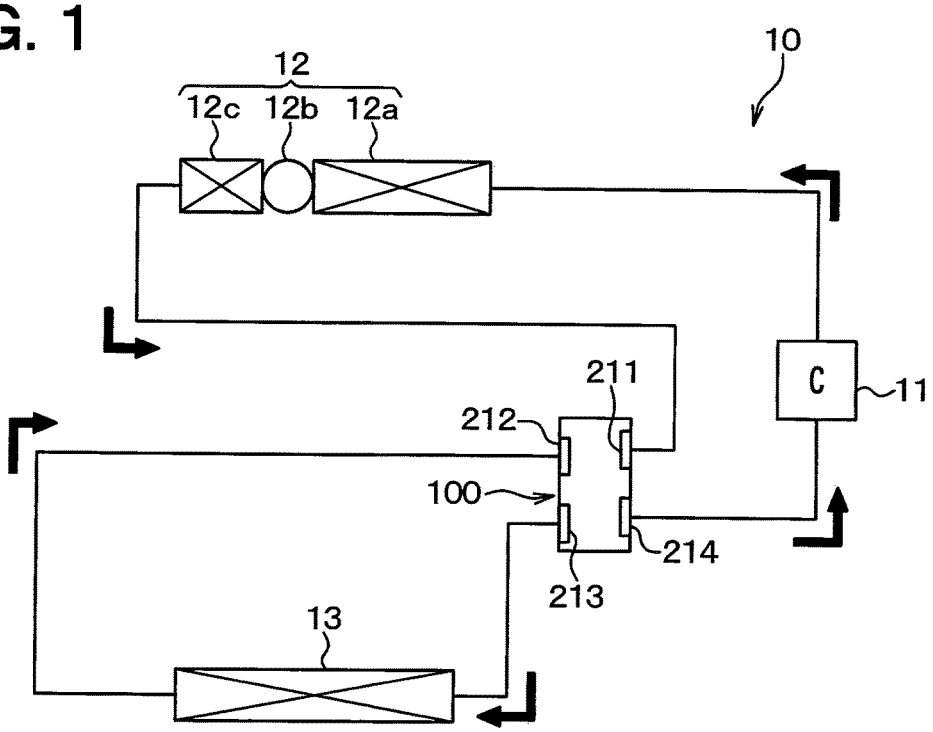
FIG. 1 is a schematic diagram of a refrigeration cycle according to a first embodiment of the present disclosure.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

In a first embodiment, an example in which an ejector 100 according to the present disclosure is applied to a vapor compression refrigeration cycle 10 configuring a vehicle air conditioning apparatus will be described. The refrigeration cycle 10 of this embodiment, as illustrated in FIG. 1, includes a compressor 11, a condenser 12, the ejector 100, and an evaporator 13, and those components are connected by refrigerant piping.

The compressor 11 is a fluid machine that draws a refrigerant, and compresses and discharges the drawn refrigerant. The compressor 11 according to this embodiment is rotationally driven by a vehicle travel engine through an electromagnetic clutch and a belt not shown. The compressor 11 is configured by, for example, a variable displacement compressor having a discharge capacity varied upon inputting a control signal from a control device not shown to an electromagnetic displacement control valve. Alternatively, the compressor 11 may be configured by an electric compressor rotationally driven by an electric motor. In the case of the electric compressor, the discharge capacity is varied according to a rotational speed of the electric motor.

The condenser 12 performs a heat exchange between the high-pressure refrigerant discharged from the compressor 11 and a vehicle exterior air (outside air) forcedly blown by a cooling fan not shown to discharge a heat of the high-pressure refrigerant to the outside air and condense and liquefy the refrigerant.

In this embodiment, a so-called "subcooling condenser" is employed. In other words, the condenser 12 according to this embodiment includes a condensation part 12*a* that performs a heat exchange between the high-pressure refrigerant and the outside air to condense the high-pressure refrigerant, a receiver 12*b* that separates gas and liquid of the refrigerant that has flowed out of the condensation part 12*a* to store an excess liquid-phase refrigerant, and a subcooling portion 12*c* that performs a heat exchange between the liquid-phase refrigerant flowing out of the receiver 12*b* and the outside air to subcool the liquid-phase refrigerant. If a pressure of the refrigerant compressed by the compressor 11 exceeds a critical pressure, since the refrigerant is not condensed and liquefied by the condenser 12, the condenser 12 functions as a radiator that discharges the heat of the high-pressure refrigerant to the outside air. A refrigerant outflow side of the condenser 12 is connected to a refrigerant inlet port 211 of the ejector 100.

The ejector 100 configures a depressurizing device for depressurizing the high-pressure refrigerant in a liquid phase state which flows out of the condenser 12, and also configures a fluid transport refrigerant circulation device for circulating the refrigerant by a suction action (entrainment action) of the refrigerant flow jetted at a high speed. A specific configuration of the ejector 100 will be described later.

The evaporator 13 is a heat exchanger that absorbs a heat from the outside air introduced into an air conditioning case of the air conditioning apparatus by a blower not shown, or a vehicle interior air (inside air), and evaporates the refrigerant flowing inside. A refrigerant outflow side of the evaporator 13 is connected to a refrigerant suction port 212 of the ejector 100.

The control device not shown is configured by a well-known microcomputer including a CPU and various memories, and a peripheral circuit of the microcomputer. The control device receives various operation signals from an operation panel by an occupant, and detection signals from various sensors, executes various calculations and processes on the basis of control programs stored in a memory with the use of those input signals, and controls the operation of the various devices.

The refrigeration cycle 10 according to this embodiment employs an HFC-based refrigerant (for example, R134a) as the refrigerant, and configures a subcritical refrigeration cycle in which a refrigerant pressure on a high pressure side does not exceed a critical pressure of the refrigerant. If the refrigerant configures the subcritical refrigeration cycle, an HFO-based refrigerant (for example, R1234yf) may be employed.

Subsequently, a specific configuration of the ejector 100 according to this embodiment will be described with reference to FIGS. 2 to 6. The respective up and down arrows in FIGS. 2 and 4 indicate a vertical direction in a state where the ejector 100 is mounted in a vehicle. An alternate long and short dash line X in FIG. 4 indicates an axial line of a passage formation member 240 which will be described later.

The ejector 100 according to this embodiment includes, as main components, a body 200, the passage formation member 240, and a drive device 250 that displaces the passage formation member 240.

Figure 2:
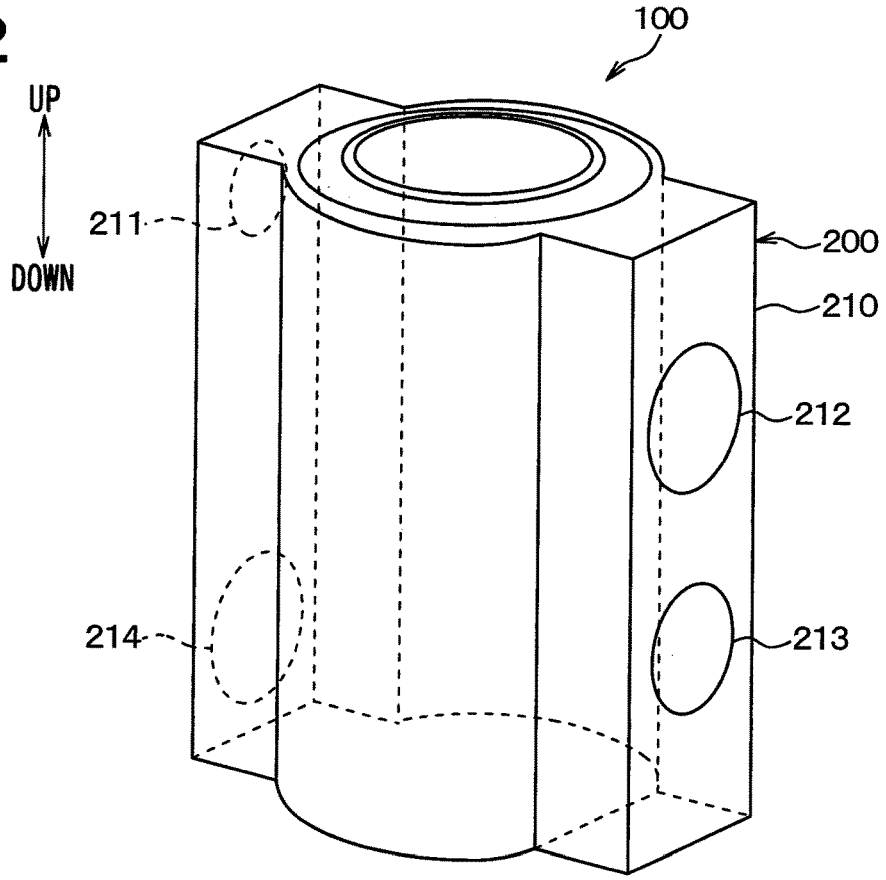
FIG. 2 is a perspective view illustrating an ejector according to the first embodiment.
Figure 3:
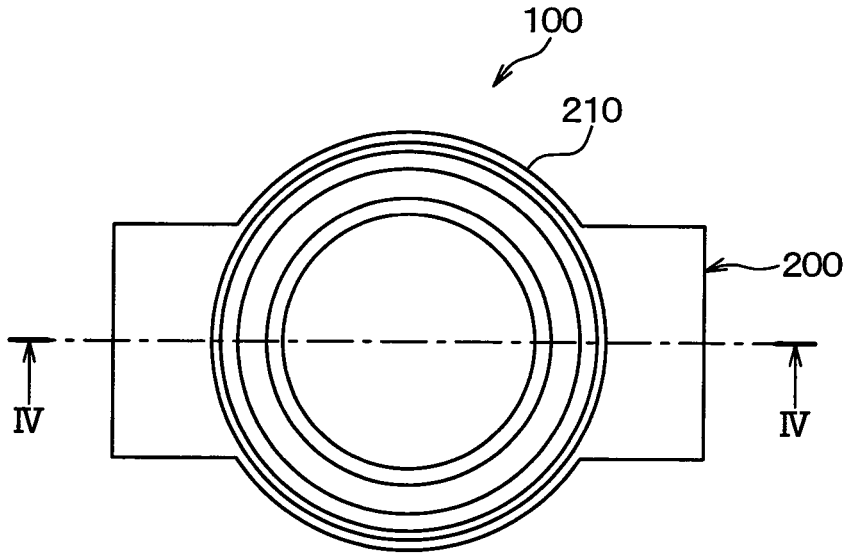
FIG. 3 is a top view illustrating the ejector according to the first embodiment.

As illustrated in FIGS. 2 and 3, the ejector 100 according to this embodiment includes the body 200 configured by combining the multiple components together. The body 200 has a metal housing body 210 shaped to couple a cylindrical member extending vertically with a prismatic member in a radial direction of the cylindrical member, and a nozzle body 220, a diffuser body 230, and the like are fixed in the housing body 210. An outer shape of the housing body 210 may merely have a cylindrical shape or a prismatic shape. In order to reduce the weight, the housing body 210 may be made of resin.

The housing body 210 is a member forming an outer shell of the ejector 100. An outside of the housing body 210 is provided with a refrigerant inlet port 211 and a refrigerant suction port 212 on an upper end side of the housing body 210, and provided with a liquid phase outlet port 213 and a gas phase outlet 214 on a lower end side. The refrigerant inlet port 211 is configured to introduce the high-pressure refrigerant from the high pressure side (condenser 12) of the refrigeration cycle 10, and the refrigerant suction port 212 is configured to draw the low-pressure refrigerant flowing out of the evaporator 13. The liquid phase outlet port 213 is configured to allow the liquid-phase refrigerant separated in a gas-liquid separation space 260 which will be described later to flow to a refrigerant inlet side of the evaporator 13, and the gas phase outlet 214 is configured to allow the gas-phase refrigerant separated in the gas-liquid separation space 260 to flow to an intake side of the compressor 11.

Figure 4:
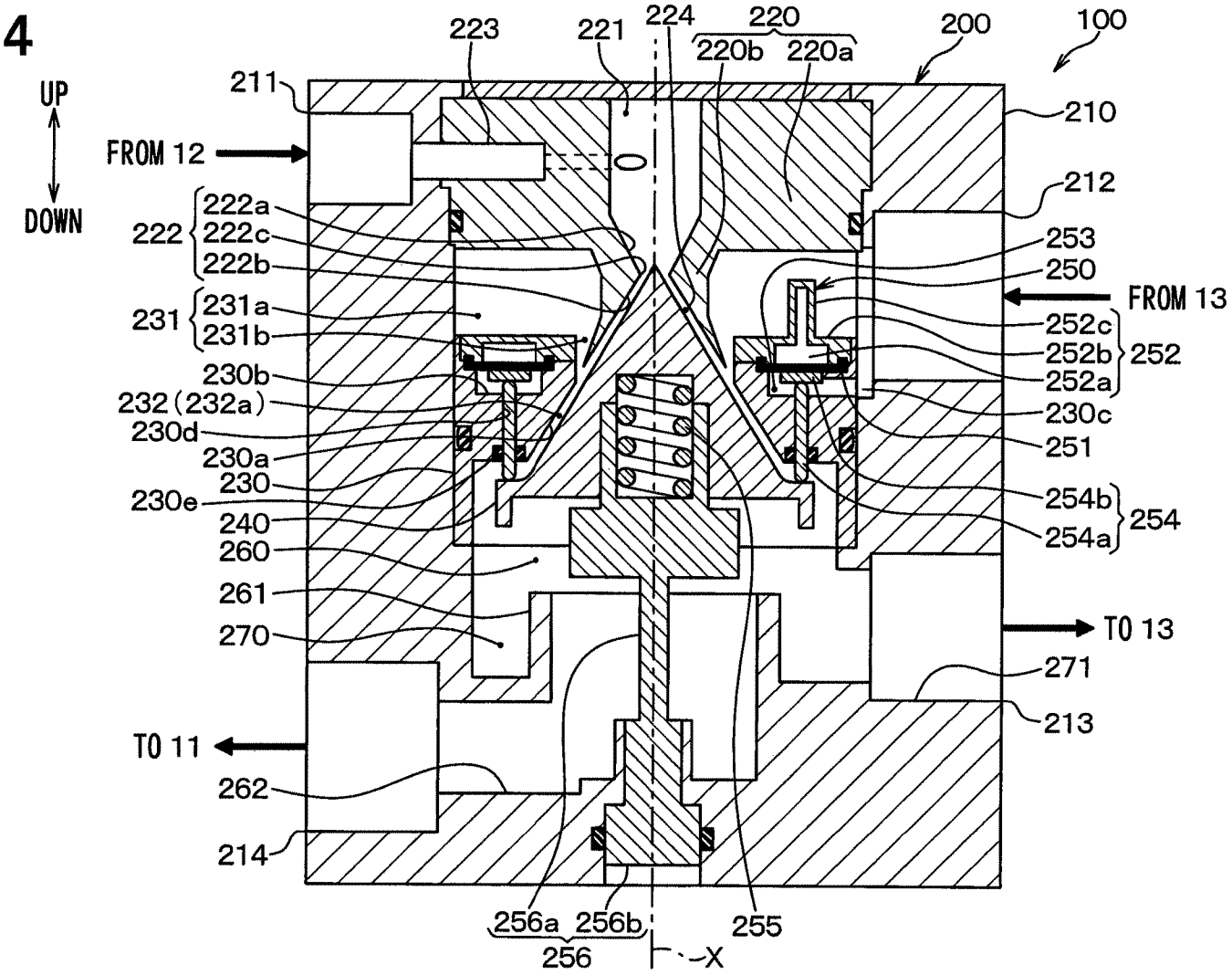
FIG. 4 is a sectional view taken along a line IV-IV in FIG. 3.

As illustrated in FIG. 4, the nozzle body 220 is housed on an upper end side in the interior of the housing body 210. More specifically, the nozzle body 220 is housed in the interior of the housing body 210 in such a manner that a part of the nozzle body 220 overlaps (overlaps) with the refrigerant inlet port 211 in a direction orthogonal to a direction (vertical direction) of the axial line X of the passage formation member 240, which will be described later. The nozzle body 220 is fixed to the interior of the housing body 210 in a state where a seal member such as an O-ring is interposed between the nozzle body 220 and the housing body 210 by a method such as a press fitting.

The nozzle body 220 according to this embodiment is configured by an annular metal member, and includes a body part 220*a* having a size compatible with an internal space of the housing body 210, and a cylindrical nozzle portion 220*b* disposed on a lower side of the body part 220*a* and protruding downward.

The body part 220*a* of the nozzle body 220 defines a swirling space 221 in which the high-pressure refrigerant flowing out of the refrigerant inlet port 211 is swirled. The nozzle portion 220*b* of the nozzle body 220 defines the depressurizing space 222 through which the refrigerant swirled in the swirling space 221 passes and is depressurized.

The swirling space 221 is a space shaped into a rotating body whose center axis extends in a vertical direction (vertical direction). The rotating body shape is a cubic shape obtained by rotating a plane figure around one straight line (center axis) on the same plane. More specifically, the swirling space 221 according to this embodiment has a substantially cylindrical shape. The swirling space 221 may have a shape in which a cone or a truncated cone is coupled with a cylinder.

The swirling space 221 according to this embodiment is connected to the refrigerant inlet port 211 through a refrigerant inflow passage 223 defined in the housing body 210 and the body part 220*a* of the nozzle body 220.

The refrigerant inflow passage 223 extends in a tangential direction of an inner wall surface of the swirling space 221 in a cross-section perpendicular to a center axis direction of the swirling space 221. As a result, the refrigerant flowing into the swirling space 221 from the refrigerant inflow passage 223 flows along an inner wall surface of the swirling space 221, and swirls in the swirling space 221. The refrigerant inflow passage 223 does not need to completely match the tangential direction of the swirling space 221 in the cross-section perpendicular to the center axis direction of the swirling space 221. In other words, if the refrigerant inflow passage 223 has a shape in which the refrigerant flowing into the swirling space 221 flows along the inner wall surface of the swirling space 221, the refrigerant inflow passage 223 may include components (for example, the center axis direction of the swirling space 221) in the other directions.

Since a centrifugal force is exerted on the refrigerant swirled in the swirling space 221, a refrigerant pressure on the center axis side is reduced more than the refrigerant pressure on an outer peripheral side within the swirling space 221. Under the circumstances, in this embodiment, at the time of operating the refrigeration cycle 10, the refrigerant pressure on the center axis side in the swirling space 221 is reduced down to a pressure of a saturated liquid-phase refrigerant or a pressure at which the refrigerant is depressurized and boiled (generates cavitation).

The adjustment of the refrigerant pressure on the center axis side of the swirling space 221 can be realized by adjusting a swirling flow rate of the refrigerant swirled in the swirling space 221. Specifically, the adjustment of the swirling flow rate can be performed by adjusting a ratio of a passage cross-sectional area of the refrigerant inflow passage 223 to a cross-sectional area in a direction orthogonal to a center axis of the swirling space 221. The above swirling flow rate means a flow rate of the refrigerant in the swirling direction in the vicinity of an outermost peripheral part of the swirling space 221.

The depressurizing space 222 is provided on a lower side of the swirling space 221 so that the high-pressure refrigerant swirled in the swirling space 221 flows into the depressurizing space. The depressurizing space 222 according to this embodiment is defined so that a center axis of the depressurizing space is coaxial with that of the swirling space 221.

The depressurizing space 222 is shaped to couple a truncated conical hole (convergent part 222*a*) whose flow path cross-sectional area is continuously decreased downward (downstream side in the refrigerant flow direction) with a truncated conical hole (divergent part 222*b*) whose flow channel cross-sectional area is continuously increased downward. A connection portion between the convergent part 222*a* and the divergent part 222*b* in the depressurizing space 222 forms a nozzle throat (minimum passage area part) 222*c* in which the flow channel cross-sectional area is most reduced.

In the divergent part 222*b*, since the depressurizing space 222 overlaps (overlaps) with an upper side of the passage formation member 240 to be described later in the radial direction of the center axis of the depressurizing space 222, a cross-sectional shape perpendicular to the center axis is annularly shaped (donut-shaped).

In this embodiment, the depressurizing space 222 has a nozzle passage 224 functioning as a nozzle between an inner peripheral surface of the nozzle body 220 and an outer peripheral surface of the upper side of the passage formation member 240 which will be described later.

Subsequently, the diffuser body 230 is housed on a lower side of the nozzle body 220 in the interior of the housing body 210. More specifically, the diffuser body 230 is housed in the interior of the housing body 210 in such a manner that a part of the diffuser body 230 overlaps (overlaps) with the refrigerant suction port 212 in a direction orthogonal to the axial line X (vertical direction) of the housing body 210. The diffuser body 230 is fixed to the interior of the housing body 210 in a state where a seal member such as an O-ring is interposed between the nozzle body 220 and the housing body 210 by a method such as a press fitting.

The diffuser body 230 according to this embodiment includes an annular metal member provided with a through hole 230*a* shaped into a rotating body which penetrates through a center part of the diffuser body 230, and a groove portion 230*b* for housing the drive device, which will be described later, on an outer peripheral side of the through hole 230*a*. A center axis of the through hole 230*a* is coaxial with that of the swirling space 221 and the depressurizing space 222.

A suction space 231*a* is defined between an upper surface of the diffuser body 230 and a lower surface of the nozzle body 220 facing the upper surface of the diffuser body 230. The refrigerant flowing from the refrigerant suction port 212 stays in the suction space 231*a*. In this embodiment, since a tip part of the lower side of the nozzle body 220 is located in the interior of the through hole 230*a* of the diffuser body 230, the suction space 231*a* has an annular cross-sectional shape when viewed from a direction of the center axis of the swirling space 221 and the depressurizing space 222.

In an area in which a lower side of the nozzle body 220 is inserted, that is, an area in which the diffuser body 230 overlaps with the nozzle body 220 in the radial direction, in the through hole 230*a* of the diffuser body 230, a refrigerant passage cross-sectional area is gradually reduced toward a refrigerant flow direction.

With the above configuration, a suction passage 231*b* is defined between an inner peripheral surface of the through hole 230*a* and an outer peripheral surface of a lower side of the nozzle body 220. In the suction passage 231*b*, the suction space 231*a* communicates with a refrigerant flow downstream side of the depressurizing space 222. In other words, in this embodiment, a suction portion (suction passage) 231 is configured by the suction space 231*a* and the suction passage 231*b*, and a suction refrigerant flows from an outer peripheral side of the center axis toward an inner peripheral side in the suction portion 231. Further, a cross-sectional shape perpendicular to the center axis of the suction portion 231 is also annular. The suction portion (suction passage) 231 communicates with a refrigerant flow downstream side of the depressurizing space 222, and the refrigerant drawn through the refrigerant suction port 212 flows in the suction portion 231.

A pressurizing space 232 having a substantially truncated conical shape gradually spread toward the refrigerant flow direction is defined in the refrigerant flow downstream side of the suction passage 231*b* in the through hole 230*a* of the diffuser body 230. The pressurizing space 232 is a space in which the ejection refrigerant jetted from the above-mentioned nozzle passage 224 is mixed with the suction refrigerant drawn from the suction portion 231 to increase the pressure.

The pressurizing space 232 according to this embodiment increases a cross-sectional area in the radial direction toward the downstream side (lower side) in the flowing direction of the refrigerant. The pressurizing space 232 has a truncated conical shape (trumpet shape) whose cross-sectional area increases toward the lower side.

The lower side of the passage formation member 240 to be described later is disposed in the interior of the pressurizing space 232. A spread angle of a conical side of the passage formation member 240 in the pressurizing space 232 is smaller than a spread angle of the truncated conical space of the pressurizing space 232. With the above configuration, the refrigerant passage between the inner peripheral surface of the pressurizing space 232 and the outer peripheral surface of the passage formation member 240 to be described later gradually increases the refrigerant passage areas toward the refrigerant flow downstream side.

In this embodiment, the pressurizing space 232 has a diffuser passage 232*a* that functions as a diffuser between the inner peripheral surface of the diffuser body 230 and the outer peripheral surface of the passage formation member 240, and converts a velocity energy of the ejection refrigerant and the suction refrigerant into a pressure energy in the diffuser passage 232*a*. A cross-sectional shape perpendicular to the center shaft of the diffuser passage 232*a* is annular.

The passage formation member 240 is a member that defines the nozzle passage 224 in cooperation with the inner peripheral surface of the nozzle body 220, and defines the diffuser passage 232*a* in cooperation with the inner peripheral surface of the diffuser body 230. The passage formation member 240 according to this embodiment is configured by a substantially conical metal member, and housed in the interior of the housing body 210 so that at least a part of the passage formation member 240 is located in both of the depressurizing space 222 and the pressurizing space 232. The passage formation member 240 is disposed so that the center axis (axial line X) of the passage formation member 240 is coaxial with the depressurizing space 222 and the pressurizing space 232.

A portion facing the inner peripheral surface of the depressurizing space 222 in the passage formation member 240 has a curved surface along an inner peripheral surface of the divergent part 222*b* of the depressurizing space 222 so that the annular nozzle passage 224 is defined between the passage formation member 240 and the inner peripheral surface of the depressurizing space 222.

A portion facing the inner peripheral surface of the pressurizing space 232 in the passage formation member 240 has a curved surface along an inner peripheral surface of the pressurizing space 232 so that the annular diffuser passage 232*a* is defined between the passage formation member 240 and the inner peripheral surface of the pressurizing space 232.

As described above, the pressurizing space 232 has a truncated conical shape, and the passage formation member 240 has a curved surface along the inner peripheral surface of the pressurizing space 232. For that reason, the diffuser passage 232*a* spreads in a direction intersecting with the direction (center axis direction) of the axial line X of the passage formation member 240. In other words, the diffuser passage 232*a* is a refrigerant passage away from the axial line X of the passage formation member 240 toward the downstream side from the upstream side in the refrigerant flow.

Figure 7:
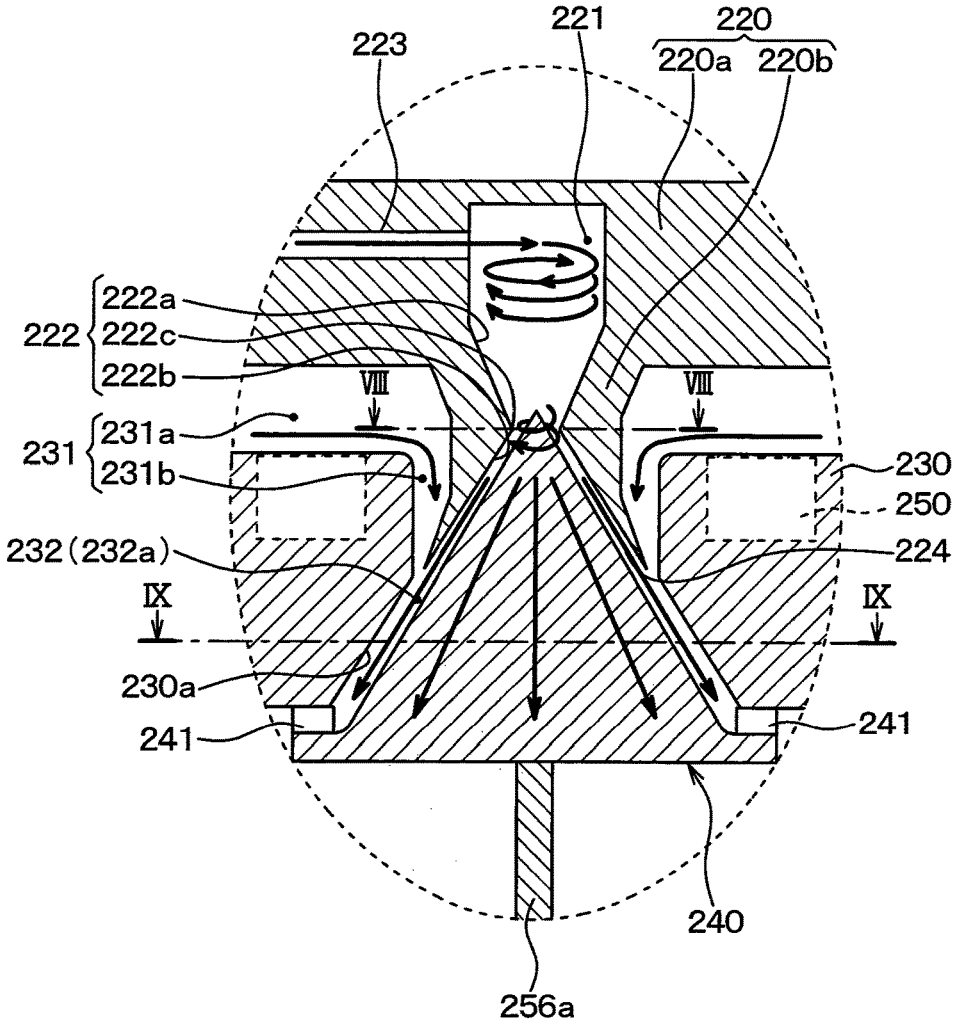
FIG. 7 is a schematic sectional diagram illustrating a part of the ejector according to the first embodiment, for illustrating functions of respective refrigerant flow channels.

As illustrated in FIG. 7, in the passage formation member 240, a fixed blade 241 is arranged in a portion of the diffuser passage 232*a* on the refrigerant flow downstream side in the passage formation member 240. The fixed blade 241 gives a gas-liquid separation swirling force to the refrigerant that has flowed out of the diffuser passage 232*a*. The fixed blade 241 is arranged at a position that does not interfere with an actuating bar 254*a* which will be described later. For convenience, in the drawings other than FIG. 7, the illustration of the fixed blade 241 is omitted.

Figure 5:
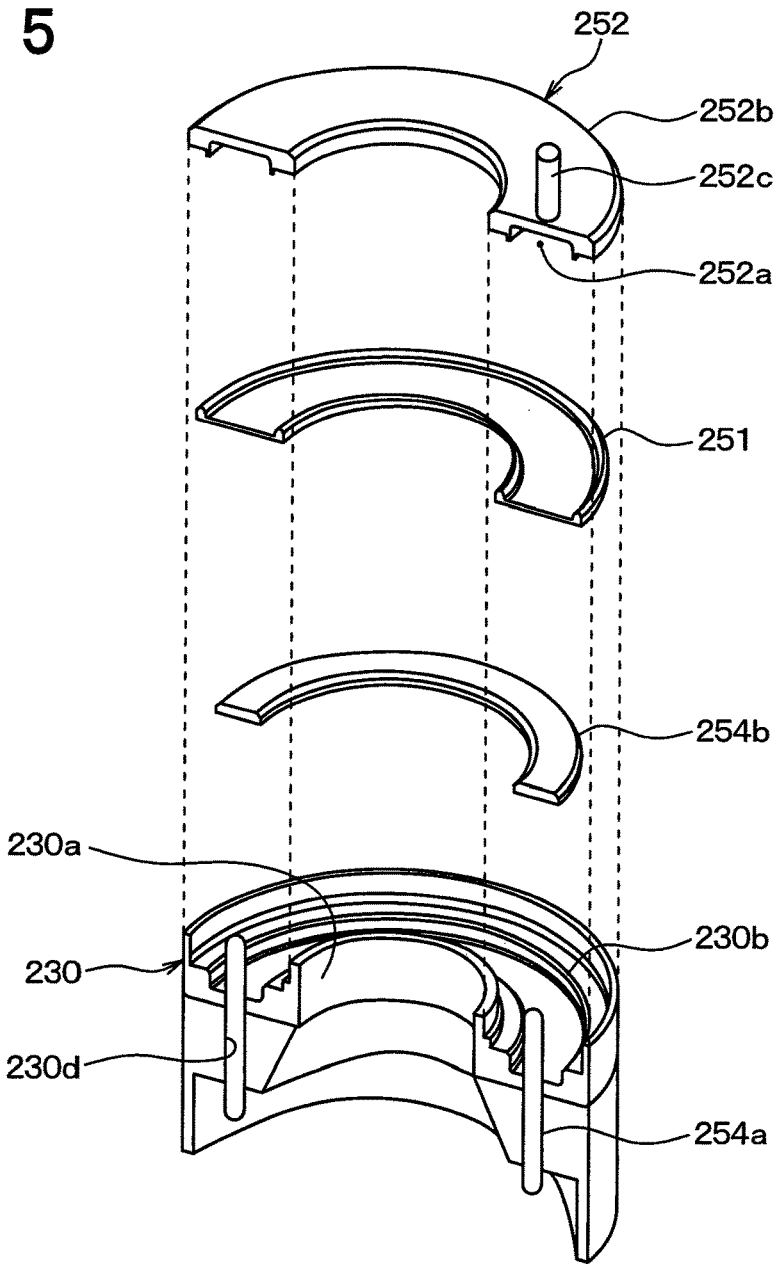
FIG. 5 is an exploded view illustrating a notched part of a drive device according to the first embodiment.

A description will be given of the drive device 250 that displaces the passage formation member 240 in the direction of the axial line X to change the refrigerant flow channel area of the nozzle passage 224 and the diffuser passage 232*a* with reference to FIGS. 4 to 6.

The drive device 250 is configured to control the amount of displacement of the passage formation member 240 so that the degree of superheat (temperature and pressure) of the low-pressure refrigerant flowing out of the evaporator 13 falls within a predetermined range.

The drive device 250 according to this embodiment is housed in the body 200 so as not to be affected by an external ambient temperature. The drive device 250 has an annular thin plate diaphragm 251 used as an example of the pressure responsive member.

The diaphragm 251 according to this embodiment has an annular shape that can be arranged in the annular groove portion 230*b* disposed in the diffuser body 230. The diaphragm 251 is arranged around the axial line X of the passage formation member 240 so as not to interfere with the passage formation member 240.

The diaphragm 251 according to this embodiment is fixed by a technique such as swaging in a state where both of an inner peripheral edge part and an outer peripheral edge part of the diaphragm 251 are sandwiched between an inner wall surface of the groove portion 230*b* defined in the diffuser body 230 and an annular cover member 252*b* that closes the groove portion 230*b*. The diaphragm 251 is fixed to partition an annular space defined by the groove portion 230*b* of the diffuser body 230 and the cover member 252*b* into two upper and lower spaces.

The upper space (suction space 231*a* side) of the two spaces partitioned by the diaphragm 251 configures a sealed space 252*a* in which a temperature sensitive medium is sealed. A pressure of the temperature sensitive medium changes according to a temperature of the refrigerant that has flowed out of the evaporator 13. A temperature sensitive medium (for example, R134a) mainly identical with a refrigerant flowing in the refrigeration cycle 10 is sealed in the sealed space 252*a* with a predetermined density. As the temperature sensitive medium, a mixed gas of the refrigerant flowing in the cycle and helium gas may be employed.

The sealed space 252*a* according to this embodiment configures an annular space compatible with the shape of the diaphragm 251, and is disposed around the axial line X of the passage formation member 240 so as not to interfere with the passage formation member 240.

In more detail, the sealed space 252*a* according to this embodiment is disposed at a position adjacent to the suction portion 231 in the diffuser body 230, which is surrounded by the suction portion 231 and the diffuser passage 232*a*. With the above configuration, a temperature of the suction refrigerant flowing in the suction portion 231 is transmitted to the temperature sensitive medium in the sealed space 252*a*, and an internal pressure in the sealed space 252*a* is a pressure depending on the temperature of the suction refrigerant flowing in the suction portion 231.

On the other hand, the lower space of the two spaces partitioned by the diaphragm 251 configures an introduction space 253 into which the refrigerant that has flowed out of the evaporator 13 is introduced through a communication path 230*c* defined in the diffuser body 230. The introduction space 253 is a pressure chamber that exerts a pressure of the suction refrigerant in the suction portion 231 (suction passage) on the diaphragm 251 so as to counteract the pressure of the temperature sensitive medium.

Therefore, the temperature of the refrigerant that has flowed out of the evaporator 13, that is, the suction refrigerant flowing in the suction portion 231 is transmitted to the temperature sensitive medium sealed in the sealed space 252*a* through the cover member 252*b* and the diaphragm 251.

In order to realize a superheat control with higher precision by the drive device 250, it is important to bring the temperature of the temperature sensitive medium closer to the temperature of the refrigerant that has flowed out of the evaporator 13 (to reduce a temperature difference). The temperature sensitive medium is a medium whose pressure is changed with a change in the temperature, and the pressure of the temperature sensitive medium is approximated to a saturated pressure of the temperature sensitive medium at the lowest temperature.

Under the circumstances, in this embodiment, in order to bring the temperature of the temperature sensitive medium closer to the temperature of the suction refrigerant in the suction space 231*a*, a temperature sensitive cylinder 252*c* protruded toward the suction space 231*a* side from the cover member 252*b* is disposed on an upper part of the cover member 252*b*. The temperature sensitive cylinder 252*c* is located in the suction space 231*a* so as to be exposed to the suction refrigerant flowing in the suction space 231*a*.

Further, in this embodiment, in order to bring the temperature of the temperature sensitive medium further closer to the temperature of the refrigerant that has flowed out of the evaporator 13, the temperature sensitive cylinder 252*c* is arranged at a position closer to the refrigerant suction port 212 than the axial line X of the passage formation member 240 in the suction space 231*a*. In other words, a distance between the axial line X and the temperature sensitive cylinder 252*c* is longer than a distance between the refrigerant suction port 212 and the temperature sensitive cylinder 252*c*.

In this example, the temperature sensitive cylinder 252*c* may function as an introduction part for introducing the temperature sensitive medium into the sealed space 252*a* in a manufacturing process. According to this configuration, there is no need to additionally provide the introduction part for introducing the temperature sensitive medium into the sealed space 252*a*, and the ejector 100 can be simplified as much.

In this embodiment, since the temperature sensitive cylinder 252*c* is disposed at a position closer to the refrigerant suction port 212, the temperature of the temperature sensitive medium in the temperature sensitive cylinder 252*c* comes closest to the temperature of the refrigerant that has flowed out of the evaporator 13. For that reason, the cover member 252*b* that partitions the sealed space 252*a* is made of a metal material higher in thermal resistance than the temperature sensitive cylinder 252*c* so that an external heat or the heat of the high-pressure refrigerant is not transferred to the cover member 252*b*. The thermal resistance of the cover member 252*b* may be adjusted by making the cover member 252*b* of a material (including a thermal insulation material) low in heat transfer coefficient, subjecting inner and outer surfaces of the cover member 252*b* to coating for reducing the heat transfer coefficient, or increasing a thickness of the cover member 252*b*.

In this embodiment, a temperature sensing unit 252 includes the cover member 252*b* and the temperature sensitive cylinder 252*c*, and detects the temperature of the suction refrigerant flowing in the suction portion 231. In this embodiment, the temperature sensitive cylinder 252*c* is an example of the heat transfer portion for transferring the heat of the refrigerant flowing in the suction portion 231 to the temperature sensitive medium, and the cover member 252*b* is an example of a portion other than the heat transfer portion.

In this example, the diaphragm 251 is deformed according to a pressure difference between the internal pressure of the sealed space 252*a* and the pressure of the refrigerant introduced into the introduction space 253, always contacts the refrigerant, and is required to ensure the airtightness of the sealed space 252*a* and a resistance to the pressure of the refrigerant.

For that reason, the diaphragm 251 may be made of a material excellent in toughness, a heat resistance, a gas barrier property, and a sealing property. The diaphragm 251 can be made of a rubber base material such as EPDM (ethylene propylene rubber) or HNBR (hydrogenated nitrile rubber) containing base fabric (polyester).

Figure 6:
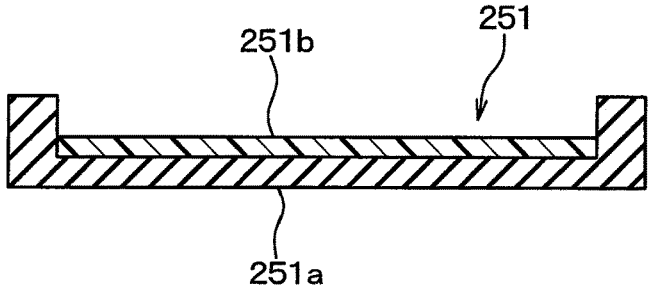
FIG. 6 is a schematic sectional view illustrating a diaphragm according to the first embodiment.

Specifically, as illustrated in FIG. 6, in the diaphragm 251, a rubber base material 251*a* may be integrated with a barrier film 251*b* for suppressing a leakage of the temperature sensitive medium from the sealed space 252*a*. FIG. 6 illustrates an example in which the barrier film 251*b* is integrated with one surface of the base material 251*a*, but without being limited to this configuration, the barrier film 251*b* may be disposed on both surfaces of the base material 251*a*, or the barrier film 251*b* may be disposed inside of the base material 251*a*.

In this example, the integration of the rubber base material 251*a* and the barrier film 251*b* may be performed by sandwiching the barrier film 251*b* in which a film higher in melting point than a crosslinking temperature of the base material 251*a*, which is made of, for example, aluminum foil or polyimide, is laminated by PET (polyethylene terephthalate) between the rubber base material 251*a*. Alternatively, the rubber base material 251*a* and the barrier film 251*b* may be integrated together by coating the barrier film 251*b* on a surface of the rubber base material 251*a* by spray coating.

The drive device 250 according to this embodiment has a transmission member 254 for transmitting a displacement of the diaphragm 251 to the passage formation member 240. The transmission member 254 according to this embodiment includes multiple cylindrical actuating bars 254*a* arranged so that one end of each actuating bar 254*a* contacts the passage formation member 240, and a plate member 254*b* disposed to contact both another ends of the respective actuating bars 254*a* and the diaphragm 251.

The actuating bars 254*a* are arranged to penetrate through sliding holes 230*d* defined on a radially outer side of the through hole 230*a* in the diffuser body 230, one end side of the actuating bars 254*a* contacts an outer periphery of a lower side of the passage formation member 240, and the other end side of the actuating bars 254*a* contacts the plate member 254*b*. The sliding holes 230*d* are provided in the diffuser body 230 so as to extend in the direction of the axial line X of the passage formation member 240, and communicate the suction portion 231 with the downstream side of the diffuser passage 232*a*. The sliding holes 230*d* are provided to slide the actuating bars 254*a* in the direction of the axial line X of the passage formation member 240.

The respective actuating bars 254*a* may be evenly arranged in a circumferential direction of the diffuser body 230 so that the displacement of the diaphragm 251 is accurately transmitted to the passage formation member 240. Gaps between the actuating bars 254*a* and the sliding holes 230*d* of the diffuser body 230 into which the actuating bars 254*a* are inserted are sealed by respective sealing members 230*e* such as O-rings. With the above configuration, the refrigerant is unlikely to be leaked from the gaps when the actuating bars 254*a* are displaced.

In this example, when the actuating bars 254*a* are fixed to the passage formation member 240 or the plate member 254*b* by welding, the axes of the actuating bars 254*a* are inclined with respect to the axial line X of the passage formation member 240 due to a warp of the diaphragm 251 or a variation in the pressure of the temperature sensitive medium. When the axis of the actuating bars 254*a* is inclined with respect to the axial line X of the passage formation member 240, the passage formation member 240 is likely to be displaced depending on the degree of superheat (temperature and pressure) of the refrigerant flowing in the suction portion 231.

Under the circumstances, the actuating bars 254*a* according to this embodiment are configured so that both of portions that contact the plate member 254*b* and portions that contact the passage formation member 240 are changeable in the contact positions and the contact angles with respect to the respective members 240 and 254*b*.

Specifically, the actuating bars 254*a* are each formed into a curved shape (hemispherical shape in this embodiment) so that both of portions that contact the plate member 254*b* and portions that contact the passage formation member 240 are changeable in the contact positions and the contact angles with respect to the respective members 240 and 254*b*.

With the above configuration, the axes of the actuating bars 254*a* can be restrained from being inclined with respect to the axial line X of the passage formation member 240 due to a warp of the diaphragm 251 or a variation in the pressure of the temperature sensitive medium. The portions being in contact with the respective members 240 and 254*b* in the actuating bars 254*a* are not limited to the hemispherical shape, but may be formed into a curved shape such as a round shape. The actuating bars 254*a* may be configured so that only the portions that in contact one of the respective members 240 and 254*b* are changeable in the contact position and the contact angle with respect to the respective members 240 and 254*b*.

The plate member 254*b* is a member that couples the diaphragm 251 with the actuating bars 254*a*, which is disposed adjacent to the diaphragm 251 so as to support an intermediate part between an outer peripheral edge part and an inner peripheral edge part of the diaphragm 251. The plate member 254*b* according to this embodiment is disposed to support a surface of the introduction space 253 side in the diaphragm 251.

In order to properly transmit the displacement of the diaphragm 251 to the actuating bars 254*a*, the plate member 254*b* according to this embodiment has an annular shape so as to overlap with the diaphragm 251 in the axial direction of the passage formation member 240.

The plate member 254*b* according to this embodiment is made of a metal material so as to become higher in rigidity than the diaphragm 251. With the interposition of the plate member 254*b* between the diaphragm 251 and the actuating bars 254*a*, a force transmitted from the diaphragm 251 to the passage formation member 240 can be restrained from being changed due to a variation in the dimension of the respective actuating bars 254*a* and the warp of the diaphragm 251. In particular, when the diaphragm 251 is configured by the rubber base material 251*a*, the plate member 254*b* can also function as a barrier for restraining the temperature sensitive medium from being leaked from the diaphragm 251.

The drive device 250 includes a coil spring 255 that applies a load to the passage formation member 240, and a load adjusting member 256 that adjusts the load of the coil spring 255 which is exerted on the passage formation member 240.

The coil spring 255 applies the load on a bottom surface of the passage formation member 240 so as to reduce the refrigerant passage areas of the nozzle passage 224 and the diffuser passage 232*a*. The coil spring 255 functions as a buffering member for attenuating the vibration of the passage formation member 240 caused by a pressure pulsation when the refrigerant is depressurized.

The load adjusting member 256 includes an adjusting bar 256*a* coupled to the coil spring 255, and an adjustment spring 256*b* for displacing the adjusting bar 256*a* vertically. The load adjusting member 256 functions as a member for adjusting the load exerted on the passage formation member 240 by the coil spring 255 to adjust a valve opening pressure of the passage formation member 240 and finely adjust a target degree of superheat.

The drive device 250 configured as described above is adjusted so that the diaphragm 251 displaces the passage formation member 240 according to the temperature and the pressure of the refrigerant that has flowed out of the evaporator 13 whereby the degree of superheat of the refrigerant on an outlet side of the evaporator 13 comes closer to a predetermine value.

For example, when the temperature and the pressure of the refrigerant that has flowed out of the evaporator 13 are high, and the load of the refrigeration cycle 10 is high, the diaphragm 251 displaces the passage formation member 240 so that the refrigerant passage areas of the nozzle passage 224 and the diffuser passage 232*a* become larger. As a result, a refrigerant flow rate flowing in the refrigeration cycle 10 increases.

On the other hand, when the temperature and the pressure of the refrigerant that has flowed out of the evaporator 13 are low, and the load of the refrigeration cycle 10 is low, the diaphragm 251 displaces the passage formation member 240 so that the refrigerant passage areas of the nozzle passage 224 and the diffuser passage 232*a* become smaller. As a result, a refrigerant flow rate flowing in the refrigeration cycle 10 decreases.

Subsequently, a description will be given of a configuration of a lower side of the passage formation member 240 in the ejector 100. The gas-liquid separation space 260 that separates gas-liquid in the mixed refrigerant flowing out of the diffuser passage 232*a* from is disposed between the passage formation member 240 and the bottom surface of the interior of the housing body 210. The gas-liquid separation space 260 is a substantially cylindrical space, and a center axis of the gas-liquid separation space 260 is coaxial with the center axes of the swirling space 221, the depressurizing space 222, and the pressurizing space 232.

A cylindrical pipe 261 is disposed coaxially with the gas-liquid separation space 260 and extends toward the passage formation member 240 side (upper side), and the cylindrical pipe 261 is disposed on a bottom surface of an internal space of the housing body 210. A gas phase side outflow passage 262 is defined in the interior of the cylindrical pipe 261, and the gas phase side outflow passage 262 leads the gas-phase refrigerant separated in the gas-liquid separation space 260 to the gas phase outlet port 214 provided in the housing body 210.

The liquid-phase refrigerant separated in the gas-liquid separation space 260 is stored on an outer peripheral side of the cylindrical pipe 261. A space of the cylindrical pipe 261 on the outer peripheral side in the housing body 210 configures a reservoir space 270 in which the liquid-phase refrigerant is stored. A liquid phase side outflow passage 271 is defined in a portion corresponding to the reservoir space 270 in the housing body 210, and the liquid phase side outflow passage 271 leads the liquid-phase refrigerant stored in the reservoir space 270 to the liquid phase outlet port 213.

Next, the operation of this embodiment based on the above-mentioned configuration will be described. When an air conditioning operation switch is turned on by an occupant, a control signal output from the control device causes an electromagnetic clutch of the compressor 11 to be energized, and a rotational drive force is transmitted to the compressor 11 from the vehicular travel engine through the electromagnetic clutch. The control signal is input to an electromagnetic displacement control valve of the compressor 11 from the control device, a discharge capacity of the compressor 11 is adjusted to a desired amount, and the compressor 11 compresses and discharges the gas-phase refrigerant drawn from the gas phase outlet port 214 of the ejector 100.

The gas-phase refrigerant of high temperature and high pressure discharged from the compressor 11 flows into the condensation part 12*a* of the condenser 12, cooled by the outside air, and condensed and liquefied. Thereafter, the gas-liquid is separated by the receiver 12*b*. Thereafter, the liquid-phase refrigerant separated by the receiver 12*b* flows into the subcooling portion 12*c*, and is subcooled.

The liquid-phase refrigerant flowing out of the subcooling portion 12*c* of the condenser 12 flows into the refrigerant inlet port 211 of the ejector 100. As illustrated in FIG. 7, the high-pressure refrigerant flowing into the refrigerant inlet port 211 of the ejector 100 flows into the swirling space 221 in the ejector 100 through the refrigerant inflow passage 223. The high-pressure refrigerant flowing into the swirling space 221 flows along an inner wall surface of the swirling space 221, and is put into a swirling flow that swirls in the swirling space 221. In the swirling flow described above, the pressure in the vicinity of a swirling center is reduced down to a pressure at which the refrigerant is depressurized and boiled by the action of a centrifugal force. As a result, the refrigerant can be put into a two-phase separation state in which a gas single phase of the refrigerant is present on a swirling center side, and a liquid single phase of the refrigerant is present around the gas single phase of the refrigerant.

The refrigerants of the gas single phase and the liquid single phase which swirl in the swirling space 221 flow into the depressurizing space 222 coaxial with the center axis of the swirling space 221 as the refrigerant of a gas-liquid mixed phase state, and is depressurized and expanded in the nozzle passage 224. At the time of depressing and expanding the refrigerant, the pressure energy of the refrigerant is converted into the velocity energy, and the refrigerant in the gas-liquid mixed phase state is jetted from the nozzle passage 224 at a high speed.

The above configuration will be described in detail. In the nozzle passage 224, the boiling of the refrigerant is promoted due to wall surface boiling generated when the refrigerant is peeled off from the inner wall surface side of the convergent part 222*a* of the nozzle portion 220*b*, and interface boiling generated when the refrigerant caused by boiling nucleus generated by cavitation of the refrigerant on the center side of the nozzle passage 224. As a result, the refrigerant flowing into the nozzle passage 224 is put into the gas-liquid mixed phase state in which the gas phase and the liquid phase are homogeneously mixed together.

The flow of the refrigerant put into the gas-liquid mixed state is choked (choked) in the vicinity of the nozzle throat part 222*c* of the nozzle portion 220*b*. The refrigerant in the gas-liquid mixed state reaches the sonic speed by the choking and is accelerated and jetted in the divergent portion 222*b* of the nozzle portion 220*b*.

As described above, the refrigerant of the gas-liquid mixed state can be efficiently accelerated up to the sonic speed by the boiling promotion caused by both of the wall surface boiling and the interface boiling. As a result, the energy conversion efficiency (corresponding to the nozzle efficiency) in the nozzle passage 224 can be improved.

Figure 8:
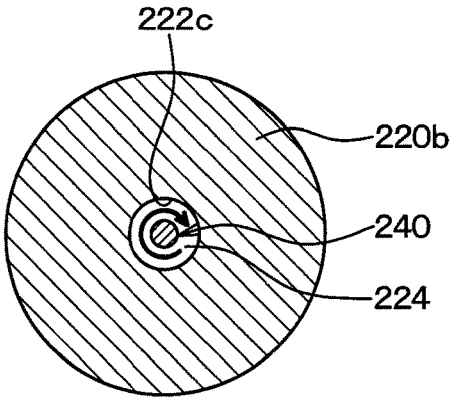
FIG. 8 is a cross-sectional view taken along a line VIII-VIII in FIG. 7.

Since the nozzle passage 224 according to this embodiment has the substantially annular shape coaxial with the swirling space 221, the refrigerant flows in the nozzle passage 224 while swirling around the passage formation member 240 as indicated by thick solid arrows in FIG. 8.

Figure 9:
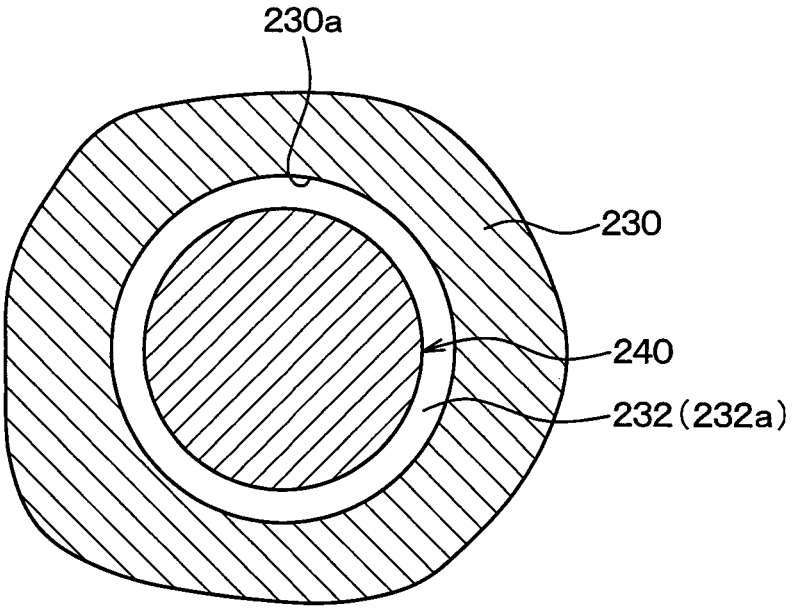
FIG. 9 is a cross-sectional view taken along a line IX-IX in FIG. 7.

The outflow refrigerant from the evaporator 13 is drawn into the suction portion 231 through the refrigerant suction port 212 due to the suction action of the refrigerant jetted from the nozzle passage 224. The mixed refrigerant of the low-pressure refrigerant drawn into the suction portion 231 and the ejection refrigerant jetted from the nozzle passage 224 flows into the diffuser passage 232*a* whose refrigerant flow channel area increases toward the refrigerant flow downstream side, and the velocity energy is converted into the pressure energy to pressurize the refrigerant. As illustrated in FIG. 9, the diffuser passage 232*a* according to this embodiment has the substantially annular shape coaxial with the nozzle passage 224.

Because the refrigerant that has flowed out of the diffuser passage 232*a* flows into the fixed blade 241, and receives a swirling force, the gas-liquid of the refrigerant is separated from each other by the action of a centrifugal force in the gas-liquid separation space 260.

The gas-phase refrigerant separated in the gas-liquid separation space 260 is drawn on an intake side of the compressor 11 through the gas phase side outflow passage 262 and the gas phase outlet port 214, and again compressed. In this situation, since the pressure of the refrigerant drawn into the compressor 11 is increased in the diffuser passage 232*a* of the ejector 100, the drive force of the compressor 11 can be reduced.

The liquid-phase refrigerant separated in the gas-liquid separation space 260 is stored in the reservoir space 270, and flows into the evaporator 13 through the liquid phase side outflow passage 271 and the liquid phase outlet port 213 due to the refrigerant suction action of the ejector 100.

In the evaporator 13, the liquid-phase refrigerant at the low pressure absorbs heat from the air flowing in the air conditioning case, and is evaporated and gasified. The gas-phase refrigerant flowing out of the evaporator 13 is drawn into the suction portion 231 through the refrigerant suction port 212 of the ejector 100, and flows into the diffuser passage 232*a*.

The ejector 100 according to this embodiment described above has the swirling space 221 in which the high-pressure refrigerant flowing from the refrigerant inlet port 211 is swirled and led to the nozzle passage 224.

As described above, when the high-pressure refrigerant is swirled in the swirling space 221, the depressurization and boiling of the refrigerant in the nozzle passage 224 is promoted, and the gas-liquid of the refrigerant can be homogenously mixed together in the nozzle passage 224. With the above configuration, since a flow rate of the ejection refrigerant from the nozzle passage 224 can be increased, the nozzle efficiency in the nozzle passage 224 can be improved. The nozzle efficiency in the nozzle passage 224 of the ejector 100 is improved in proportion to the ejection rate of the refrigerant.

In the ejector 100 according to this embodiment, the refrigerant is depressurized and boiled by not two-stage nozzles but a single nozzle passage 224. For that reason, all of the pressure energy of the refrigerant flowing into the ejector 100 is leveraged to enable a pressure increase energy to be obtained due to the diffuser passage 232*a*.

The passage formation member 240 in the ejector 100 according to this embodiment has the substantially conical shape whose cross-sectional area increases with distance from the depressurizing space 222. For that reason, the diffuser passage 232*a* can be shaped to spread toward the outer peripheral surface with distance from the depressurizing space 222. With the above shape, an increase in the dimension of the passage formation member 240 in the axial direction (direction of the axial line X of the nozzle portion) is suppressed, and a body size as the overall ejector 100 can be restrained from being upsized.

Further, in the ejector 100 according to this embodiment, the pressurizing space 232 increases the cross-sectional area in the radial direction toward the downstream side in the flowing direction of the refrigerant, and the passage formation member 240 has a curved surface along the inner peripheral surface of the pressurizing space 232. The diffuser passage 232*a* has an annular shape in a cross-section in a direction orthogonal to the center axis direction of the passage formation member 240 so that the refrigerant is swirled in the same direction as that of the refrigerant swirled in the swirling space 221.

As described above, when the refrigerant in the diffuser passage 232*a* flows to swirl around the center axis of the passage formation member 240, a flow channel for pressurizing the refrigerant can be formed into a spiral shape. As a result, since a length of the refrigerant passage for pressurizing the refrigerant can be sufficiently ensured without increasing the diffuser passage 232*a* in the axial direction of the passage formation member 240, the passage formation member 240 in the ejector 100 can be restrained from being increased toward the center axis direction. For that reason, the body size of the overall ejector 100 can be still further restrained from being upsized.

In the ejector 100 according to this embodiment, the drive device 250 that displaces the passage formation member 240 is provided. For that reason, the passage formation member 240 is displaced according to the load of the refrigeration cycle 10, and the refrigerant passage areas of the nozzle passage 224 and the diffuser passage 232*a* can be adjusted. Therefore, the amount of refrigerant corresponding to the load of the refrigeration cycle 10 can be allowed to flow, and the effective operation of the ejector 100 commensurate with the load of the refrigeration cycle 10 can be derived.

In particular, in the ejector 100 according to this embodiment, the drive device 250 is housed inside of the body 200 that is not directly affected by the external ambient temperature. According to the configuration, an influence of the external ambient temperature on the temperature sensing unit 252 in the drive device 250 is suppressed, and the refrigerant passage areas of the nozzle passage 224 and the diffuser passage 232*a* cab be appropriately changed.

Further, the diaphragm 251 and the temperature sensing unit 252 in the drive device 250 each have an annular shape surrounding the axial line X of the passage formation member 240. According to the above configuration, since the area of the diaphragm 251 which receives the pressure of the refrigerant can be sufficiently ensured, the nozzle passage 224 and the diffuser passage 232*a* can be appropriately changed according to a change in the pressure of the refrigerant flowing in the suction portion 231. As a result, the refrigerant flow rate corresponding to the load of the refrigeration cycle 10 can flow, and the operation of the ejector 100 commensurate with the load of the refrigeration cycle 10 can be derived.

The diaphragm 251 and the temperature sensing unit 252 in the drive device 250 are each formed into an annular shape surrounding the axial line X of the passage formation member 240, and the internal space in the body 200 which does not interfere with the passage formation member 240 can be effectively leveraged as a space in which the drive device 250 is installed. As a result, the body size of the overall ejector 100 can be further restrained from being upsized.

In the drive device 250 according to this embodiment, the plate member 254*b* higher in rigidity than the diaphragm 251 is interposed between the diaphragm 251 and the actuating bars 254*a*. With the above configuration, a force to be transmitted to the actuating bars 254*a* from the diaphragm 251 can be restrained from being changed due to the warp of the diaphragm 251 or the variation in the pressure of the temperature sensitive medium.

In this situation, since the plate member 254*b* according to this embodiment has an annular shape overlapping with the diaphragm 251 in the axial direction of the passage formation member 240, the force to be transmitted from the diaphragm 251 to the actuating bars 254*a* can be more properly restrained from being changed. As a result, the refrigerant flow rate corresponding to the load of the refrigeration cycle 10 can flow, and the operation of the ejector 100 commensurate with the load of the refrigeration cycle 10 can be derived.

In this embodiment, the diaphragm 251 used as the pressure responsive member has the rubber base material 251*a* formed in the annular shape. According to the above configuration, the amount of displacement (stroke) of the diaphragm 251 can be increased while a pressure resistance to a change in the internal pressure of the sealed space 252*a* is ensured.

In this situation, when the diaphragm 251 has the barrier film 251*b* made of a material higher in the gas barrier property than the base material 251*a* in addition to the rubber base material 251*a*, the temperature sensitive medium can be restrained from being leaked from the sealed space 252*a* through the rubber base material 251*a*.

In this embodiment, the portion that contacts the passage formation member 240 in the actuating bars 254*a*, and the portion that contacts the plate member 254*b* are each formed into the curved surface, and the contact positions and the contact angles with respect to the respective members 240 and 254*b* can be changeably configured. With the above configuration, the axes of the actuating bars 254*a* can be restrained from being inclined with respect to the axial line X of the passage formation member 240 due to a warp of the diaphragm 251. With the above configuration, the passage formation member 240 can be displaced according to the temperature and the pressure of the refrigerant flowing in the suction portion 231. As a result, the refrigerant flow rate corresponding to the load of the refrigeration cycle 10 can flow, and the operation of the ejector 100 commensurate with the load of the refrigeration cycle 10 can be derived.

In this embodiment, the temperature sensitive cylinder 252*c* exposed to the refrigerant flowing in the suction space 231*a* is disposed on an upper part of the cover member 252*b* of the temperature sensing unit 252. According to the above configuration, since a change in the temperature of the refrigerant flowing in the suction portion 231 can be detected by the temperature sensitive cylinder 252*c* with high precision, the passage formation member 240 can be properly displaced according to the change in the temperature of the refrigerant flowing in the suction portion 231. As a result, the refrigerant flow rate corresponding to the load of the refrigeration cycle 10 can flow, and the operation of the ejector 100 commensurate with the load of the refrigeration cycle 10 can be derived.

In this embodiment, since the temperature sensitive cylinder 252*c* is disposed in the vicinity of the refrigerant suction port 212, an influence of the external ambient temperature on the temperature sensing unit 252 is reduced, and the passage formation member 240 can be more properly displaced.

In this embodiment, as the heat transfer portion for transferring the temperature of the refrigerant flowing in the suction portion 231 of the temperature sensitive cylinder 252*c* to the temperature sensitive medium, the portion (cover member 252*b*) other than the temperature sensitive cylinder 252*c* is configured to be higher in thermal resistance than the temperature sensitive cylinder 252*c*.

As described above, the thermal resistance of the portion other than the heat transfer portion in the temperature sensing unit 252 is set to be higher whereby the influence of the external ambient temperature on the temperature sensing unit 252 is reduced, and the passage formation member 240 can be properly displaced. The portion of the cover member 252*b* in the vicinity of the refrigerant suction port 212 may be set as the heat transfer portion in addition to the temperature sensitive cylinder 252*c*, and the thermal resistance of the cover member 252*b* other than the portion in the vicinity of the refrigerant suction port 212 may be set to be higher.

The ejector 100 according to this embodiment includes a gas-liquid separation space 260 that separates the gas-liquid of the mixed refrigerant flowing out of the diffuser passage 232*a* from each other in the interior of the body 200. According to this configuration, the compact ejector 100 incorporating the gas-liquid separation device can be realized. The mixed refrigerant flowing out of the diffuser passage 232*a* is subjected to the action of centrifugation due to a swirling force given by the fixed blade 241, and the liquid-phase refrigerant larger in density flows to a side far from the axial line of the swirling flow with respect to the gas-phase refrigerant small in the density. For that reason, in the gas-liquid separation space 260, the gas-liquid of the mixed refrigerant flowing out of the diffuser passage 232*a* can be efficiently separated from each other.

The ejector 100 according to this embodiment includes the reservoir space 270 in which the liquid-phase refrigerant separated in the gas-liquid separation space 260 is stored in the body 200. According to this configuration, the compact ejector 100 incorporating the gas-liquid separation device and the reservoir device can be realized.

Modification 1 of the first embodiment will be described below. In the above-mentioned first embodiment, in order to realize the superheat control higher in precision by the drive device 250, the temperature sensitive cylinder 252*c* is disposed on the upper part of the cover member 252*b* of the temperature sensing unit 252. However, when the temperature sensitive cylinder 252*c* is located in the suction space 231*a*, a flow of the refrigerant in the suction portion 231 is blocked, and the temperature sensitive cylinder 252*c* per se may cause the pressure loss. When the pressure loss in the suction portion 231 is large, the refrigerant flow rate to be drawn is reduced, and the performance of the ejector may be degraded.

Figure 10:
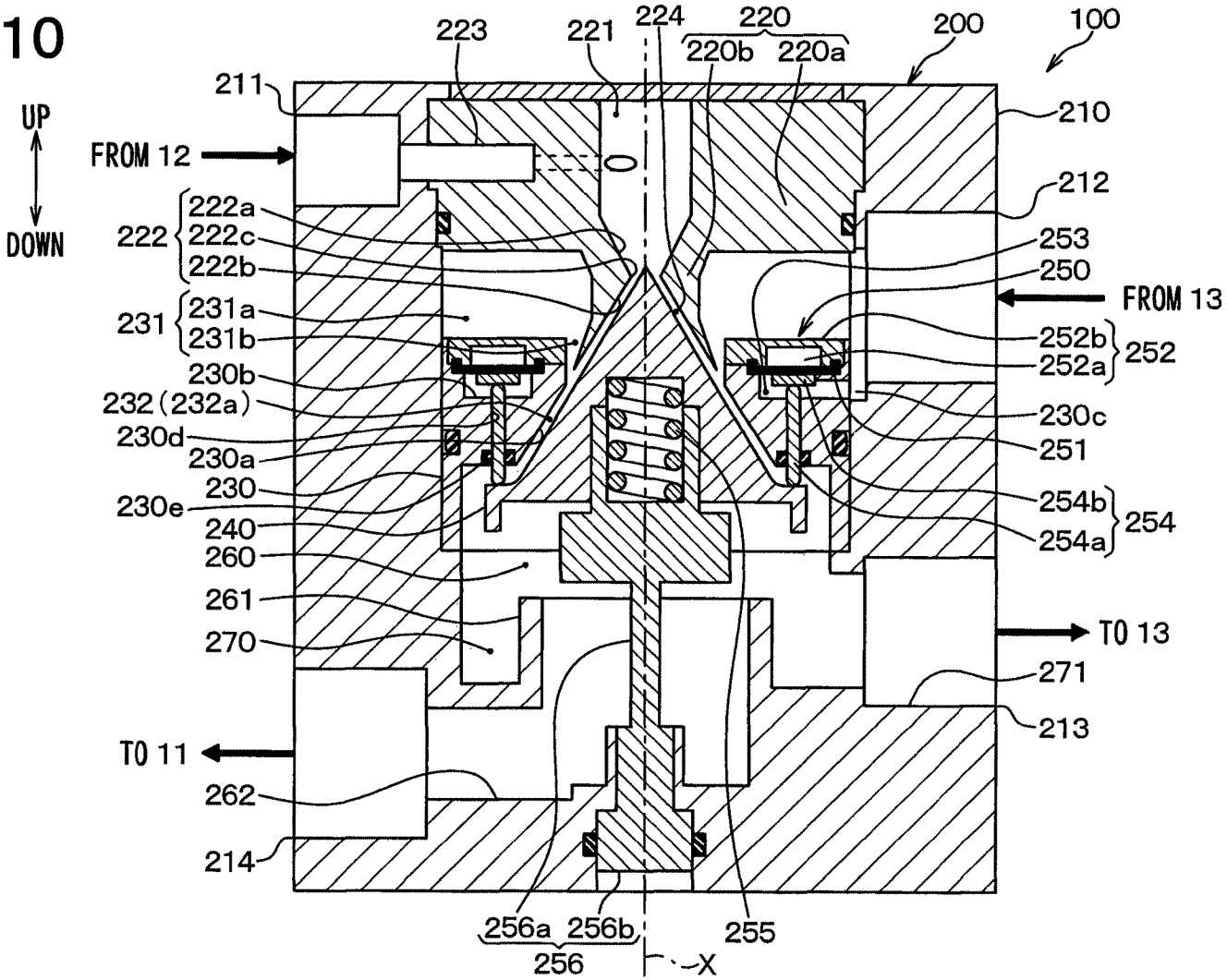
FIG. 10 is a schematic sectional view illustrating an ejector according to a first modification of the first embodiment, taken along an axial direction of the ejector.

Under the circumstances, as illustrated in FIG. 10, the temperature sensitive cylinder 252*c* may be eliminated, and the overall drive device 250 may be housed in the groove portion 230*b* of the diffuser body 230 so as not to interfere with the suction refrigerant flowing in the suction portion 231 (not to prevent the flow of refrigerant). In that case, the thermal resistance of the cover member 252*b* may be reduced so that the cover member 252*b* of the temperature sensing unit 252 functions as the heat transfer portion.

According to the above configuration, the drive device 250 can be prevented from causing the pressure loss of the refrigerant flowing in the suction portion 231. As a result, the refrigerant flow rate corresponding to the load of the refrigeration cycle 10 can flow, and the operation of the ejector 100 commensurate with the load of the refrigeration cycle 10 can be derived.

Modification 2 of the first embodiment will be described below. In the above first embodiment, the example in which the diffuser body 230 that houses the drive device 250 is formed of the annular metal member has been described. However, without being limited to this configuration, for example, the diffuser body 230 may be molded with result. In that case, in order to ensure the sealing property, metal may be inserted into the groove portion 230*b* that sandwiches the diaphragm 251 in cooperation with the cover member 252*b* in the diffuser body 230. As a result, the ejector 100 can be reduced in the weight.

Second Embodiment

Next, a second embodiment will be described. In this embodiment, an example in which a part of the configuration of the drive device 250 described in the first embodiment is changed will be described. In this embodiment, a description of the parts identical with or equivalent to those in the first embodiment will be omitted or simplified.

Figure 11:
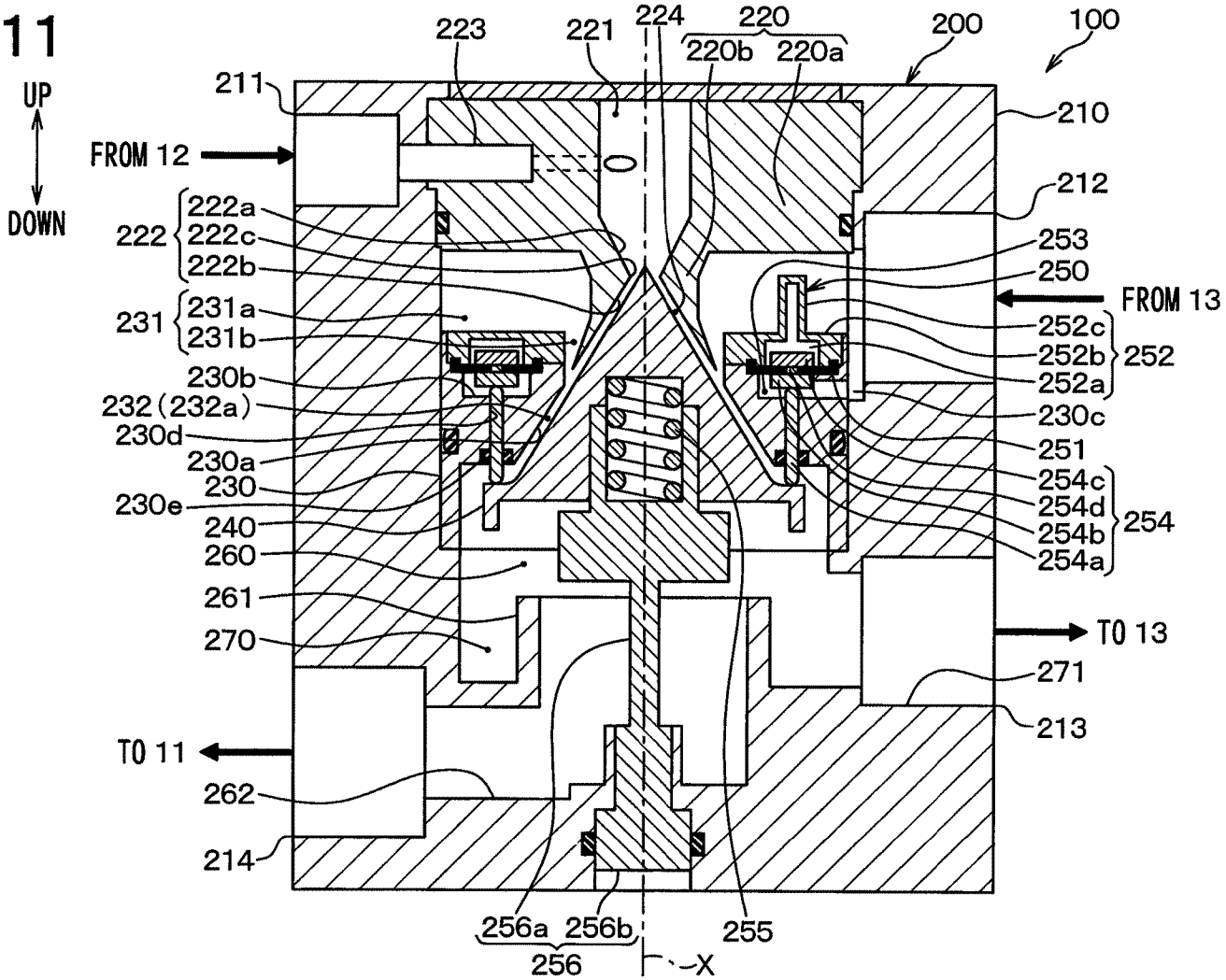
FIG. 11 is a schematic sectional view illustrating an ejector according to a second embodiment of the present disclosure, taken along an axial direction of the ejector.
Figure 12:
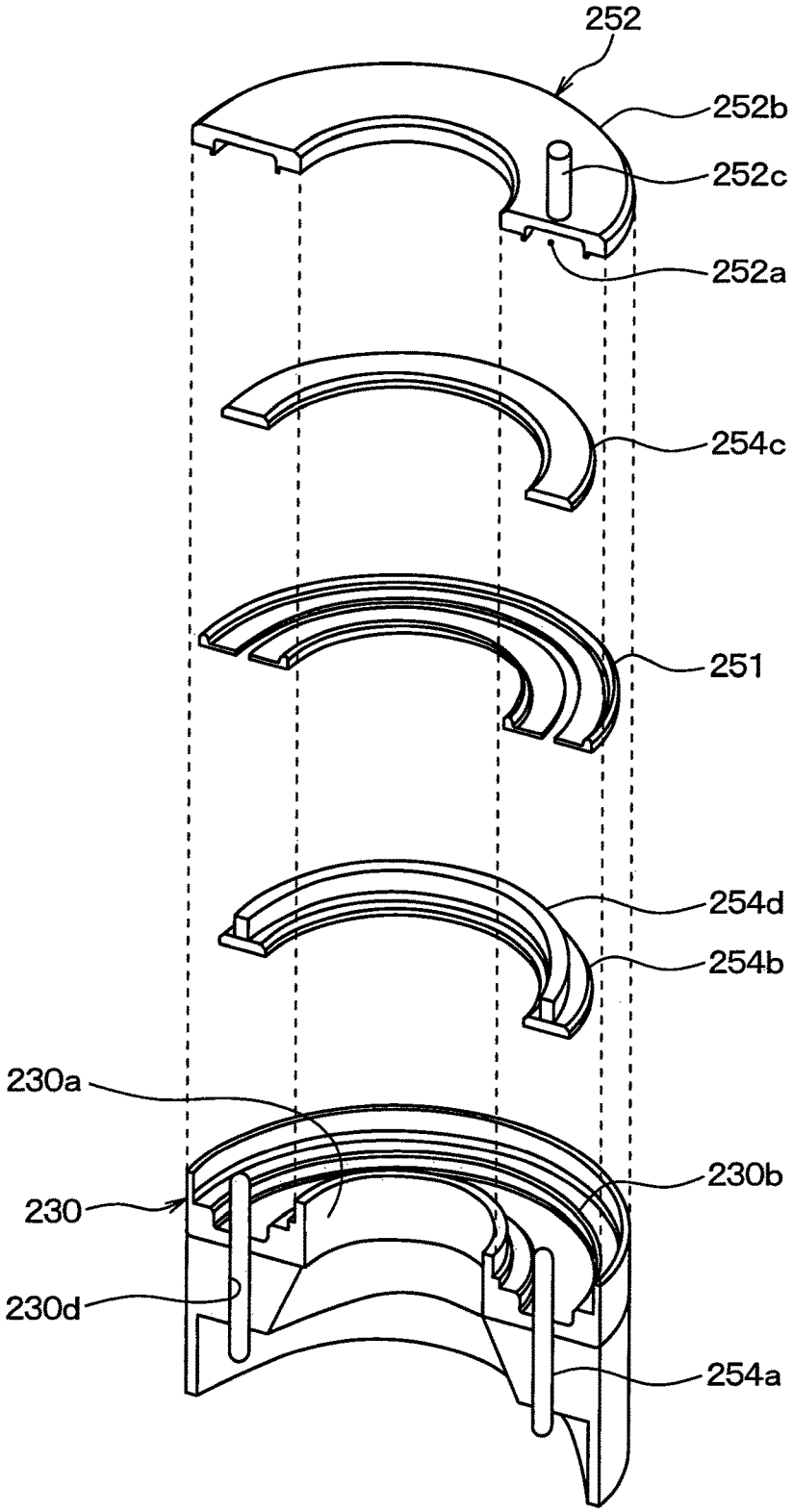
FIG. 12 is an exploded view illustrating a notched part of a drive device according to the second embodiment.

In this embodiment, as illustrated in FIGS. 11 and 12, an annular notch part is disposed between an outer peripheral edge part and an inner peripheral edge part of a diaphragm 251 in a drive device 250, and the diaphragm 251 is divided into two pieces. In this embodiment, the diaphragm 251 is sandwiched between a pair of plate members 254*b* and 254*c*.

The respective plate members 254*b* and 254*c* are coupled with each other through a coupling part 254*d* disposed in the notch part of the diaphragm 251. The coupling part 254*d* according to this embodiment is disposed in the plate member 254*b* adjacent to the introduction space 253 side of the diaphragm 251. The coupling part 254*d* may be disposed in the plate member 254*c* adjacent to the sealed space 252*a* side of the diaphragm 251.

The rest of the configuration and operation are the same as those in the first embodiment. The ejector 100 of this embodiment obtains the following advantages in addition to the advantages described in the first embodiment.

In other words, in this embodiment, the diaphragm 251 is sandwiched between a pair of plate members 254*b* and 254*c*. According to the above configuration, since an area of the diaphragm 251 exposed to the sealed space 252*a* side is reduced, the temperature sensitive medium can be effectively restrained from being leaked from the diaphragm 251 when the diaphragm 251 is made of the rubber base material 251*a*.

The diaphragm 251 is sandwiched between the pair of plate members 254*b* and 254*c* whereby abrasion of the rubber base material 251*a* caused by a friction between the respective plate members 254*b*, 254*c* and the diaphragm 251, and the warp of the diaphragm 251 can be suppressed. As a result, the nozzle passage 224 and the diffuser passage 232*a* can be properly changed according to a change in the pressure of the refrigerant flowing in the suction portion 231.

In this embodiment, the example in which a pair of plate members 254*b* and 254*c* is coupled with each other through the coupling part 254*d* has been described. However, without being limited to this configuration, the pair of plate members 254*b* and 254*c* may be attached to both surfaces of the diaphragm 251 by an adhesive or the like.

Third Embodiment

Next, a third embodiment will be described. In this embodiment, an example in which the arrangement of the drive device 250 according to the first embodiment is changed will be described. In this embodiment, a description of the parts identical with or equivalent to those in the first and second embodiments will be omitted or simplified.

In this embodiment, as illustrated in FIG. 12, the drive device 250 is housed in a groove portion 220*c* defined in the body part 220*a* of the nozzle body 220 that partitions the suction space 231*a* together with the diffuser body 230.

In the drive device 250 according to this embodiment, the overall drive device 250 is housed in the groove portion 220*c* of the nozzle body 220 so as not to prevent the suction refrigerant flowing in the suction portion 231.

Specifically, the drive device 250 is disposed so that the temperature sensing unit 252 is located on a bottom surface side of the groove portion 220*c* in the nozzle body 220, and the diaphragm 251 is located on the suction space 231*a* side of the groove portion 220*c* in the nozzle body 220.

In this embodiment, the temperature sensitive cylinder 252*c* of the temperature sensing unit 252 in the drive device 250 is omitted. In the nozzle body 220, a communication path 220*d* for introducing the refrigerant of the suction space 231*a* is disposed in the vicinity of the temperature sensing unit 252 located in the groove portion 220*c*.

In this embodiment, since the drive device 250 is housed in the groove portion 220*c* defined in the body part 220*a* of the nozzle body 220, a part of the respective actuating bars 254*a* of the transmission member 254 is exposed to the suction space 231*a*. The respective actuating bars 254*a* according to this embodiment are long in the dimension in the axial direction as compared with the respective actuating bars 254*a* in the first embodiment.

The drive device 250 according to this embodiment has an annular coupling member 257 that couples the temperature sensing unit 252 with the diaphragm 251. The coupling member 257 is coupled with the cover member 252*b* by crimping in a state where the coupling member 257 sandwiches the outer peripheral end part and the inner peripheral end part of the diaphragm 251 in cooperation with the cover member 252*b* of the temperature sensing unit 252.

Figure 13:
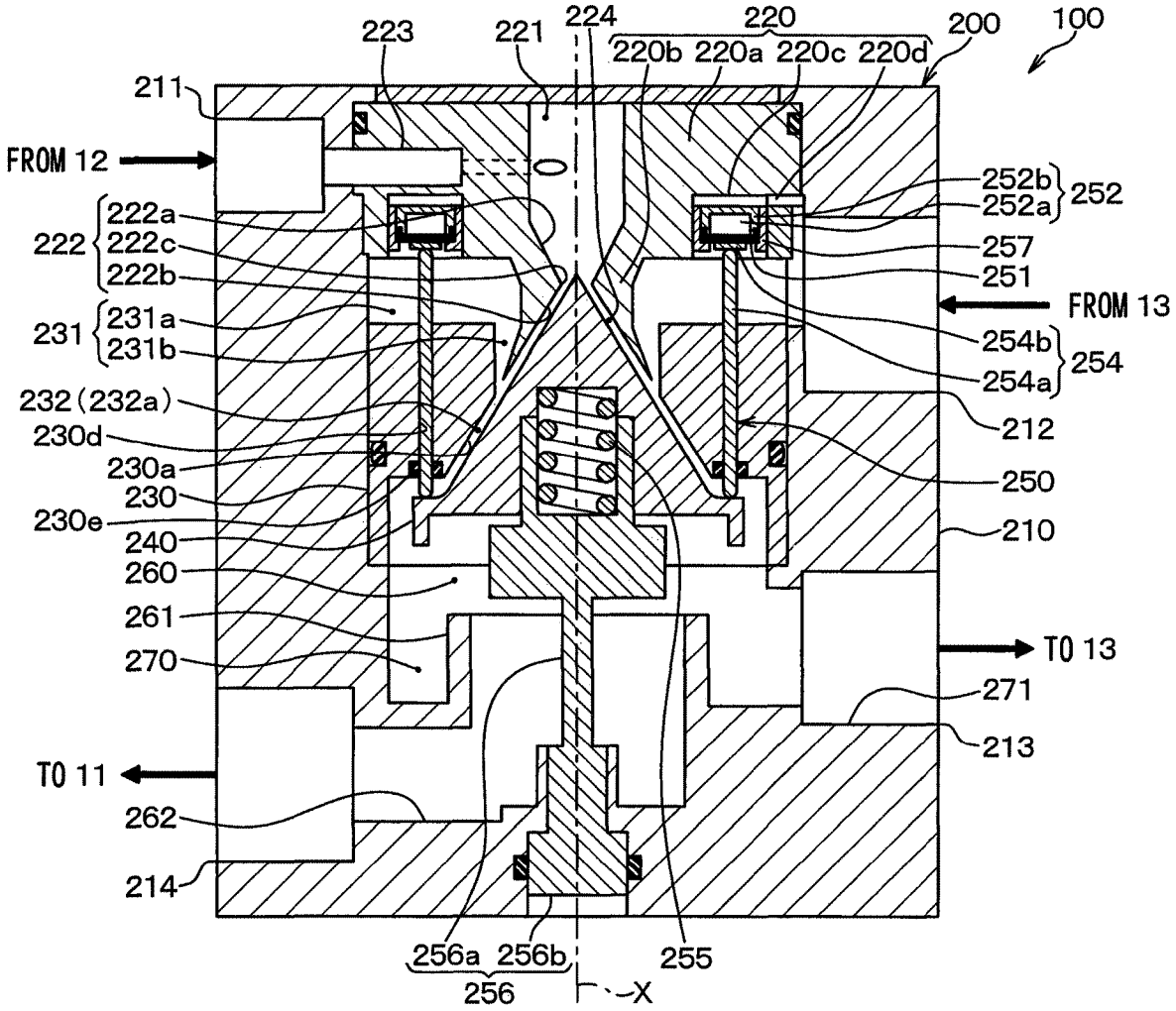
FIG. 13 is a schematic sectional view illustrating an ejector according to a third embodiment of the present disclosure, taken along an axial direction of the ejector.
Figure 14:
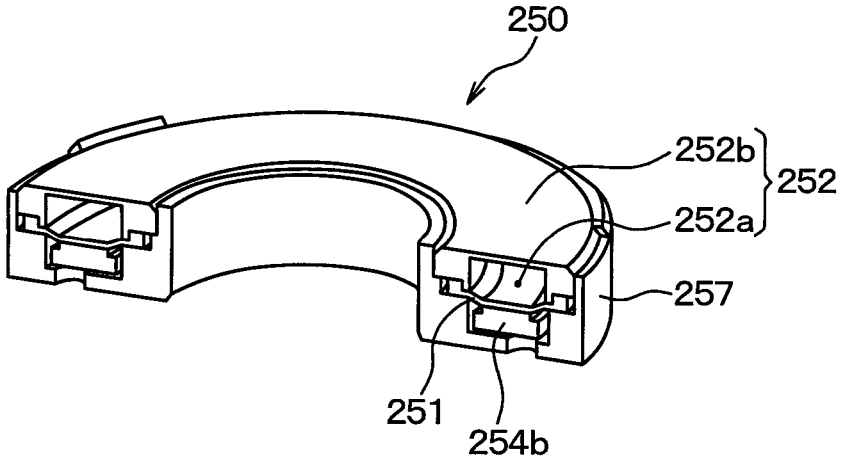
FIG. 14 is a perspective view illustrating a notched part of a drive device according to the third embodiment.

With the above configuration, as illustrated in FIG. 13, the temperature sensing unit 252, the diaphragm 251, the plate member 254*b* of the transmission member 254, and the coupling member 257, which configure the drive device 250, are configured as one drive unit, separately from the body 200.

Other structures and operations are the same as those of the first embodiment. The ejector 100 of this embodiment obtains the following advantages in addition to the advantages described in the first embodiment.

In other words, in this embodiment, the drive device 250 is housed in the groove portion 220*c* defined in the body part 220*a* of the nozzle body 220 so as not to interfere with the suction refrigerant flowing in the suction portion 231 (not to block the flow of refrigerant). According to the above configuration, the drive device 250 can be prevented from causing the pressure loss of the suction refrigerant flowing in the suction portion 231. As a result, the refrigerant flow rate corresponding to the load of the refrigeration cycle 10 can flow, and the operation of the ejector 100 commensurate with the load of the refrigeration cycle 10 can be derived.

The drive device 250 is housed in the groove portion 220*c* defined in the body part 220*a* of the nozzle body 220 whereby the dimensions of the respective actuating bars 254*a* in the axial direction can be elongated as compared with the first embodiment.

With the above configuration, the gaps between the respective actuating bars 254*a* and the sliding holes 230*d* defined in the diffuser body 230 become longer with the result that the refrigerant leakage (external equalization leakage) from the gaps can be suppressed. With the longer dimension of the actuating bars 254*a* in the axial direction, the inclination of the axes of the actuating bars 254*a* to the axial direction of the passage formation member 240 becomes smaller, and the passage formation member 240 can be restrained from being displaced depending on the degree of superheat (temperature and pressure) of the refrigerant flowing in the suction portion 231.

Further, in this embodiment, the respective components 251, 252, 254*b*, and 257 configuring the drive device 250 are configured as one drive unit, separately from the body 200. According to the above configuration, the drive device 250 can be easily assembled. Further, the degree of freedom of material selection of the respective components configuring the drive device 250 is spread, as a result of which the overall ejector 100 can be reduced in the weight.

The drive device 250 according to this embodiment is disposed so that the diaphragm 251 is located on the suction space 231*a* side of the groove portion 220*c* in the nozzle body 220. According to the above configuration, since the pressure of the refrigerant in the suction space 231*a* is exerted directly on the diaphragm 251, the pressure sensitivity of the diaphragm 251 can be improved.

Fourth Embodiment

Next, a fourth embodiment will be described. In this embodiment, an example in which the arrangement of a suction portion 231 is changed will be described. In this embodiment, a description of the parts identical with or equivalent to those in the first to third embodiments will be omitted or simplified.

Figure 15:
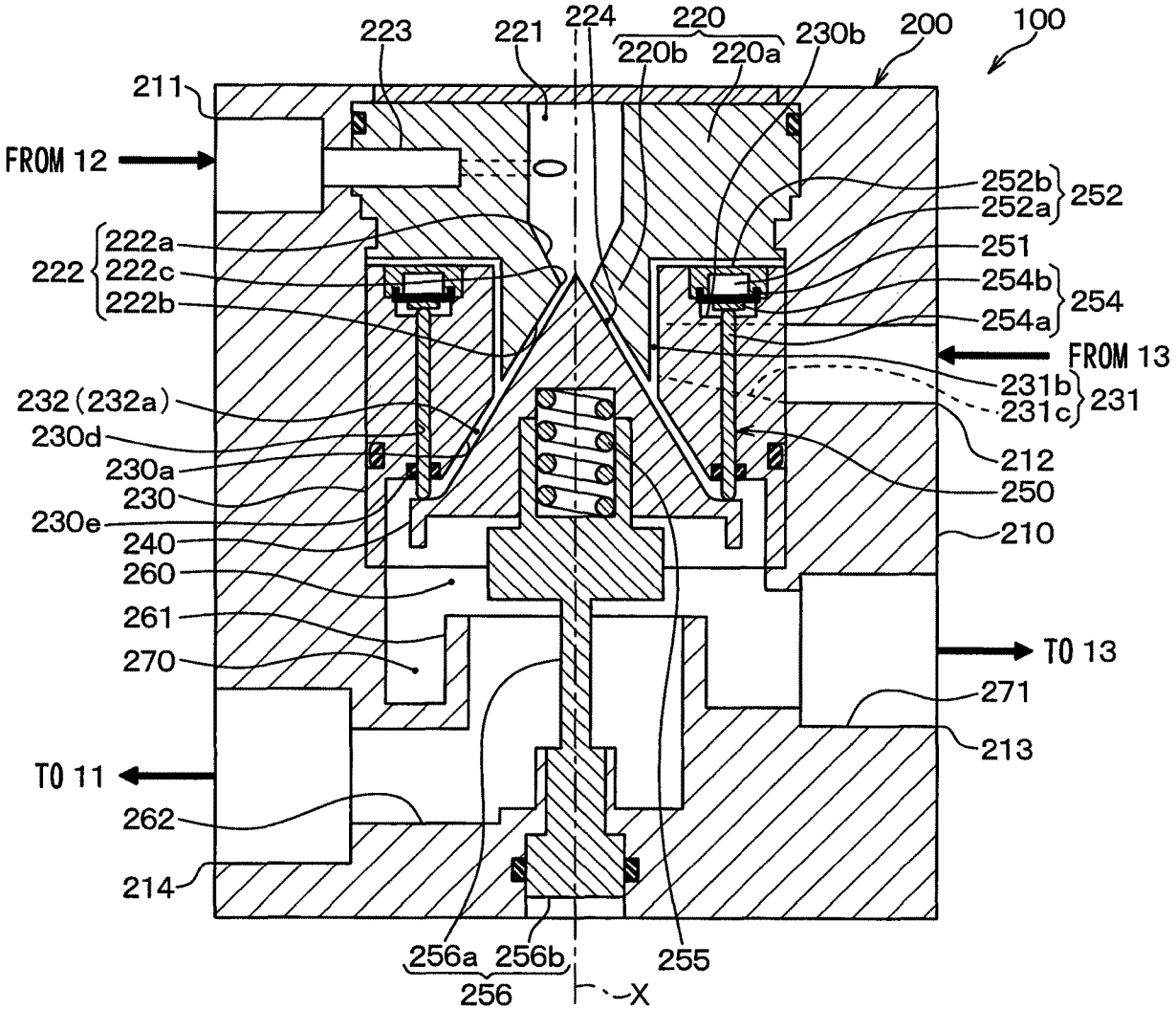
FIG. 15 is a schematic sectional view illustrating an ejector according to a fourth embodiment of the present disclosure, taken along an axial direction of the ejector.

In this embodiment, as illustrated in FIG. 15, an upper portion of a diffuser body 230 is enlarged so that an upper part of the upper portion approaches a lower side of a nozzle body 220 so as to fill a space configuring the suction space 231*a* in the first embodiment. As in the first embodiment, the drive device 250 according to this embodiment is housed in the groove portion 230*b* defined in an upper part of the diffuser body 230.

In this embodiment, a refrigerant introduction passage 231*c* for introducing the refrigerant drawn from the refrigerant suction port 212 is defined in the interior (lower portion of the drive device 250) of the diffuser body 230. The refrigerant introduction passage 231*c* is not annular unlike the suction space 231*a*, but is configured as a refrigerant passage extending in a direction intersecting with the axial line X of the passage formation member 240. The refrigerant introduction passage 231*c* according to this embodiment extends toward the axial line X of the passage formation member 240 from the refrigerant suction port 212 side.

Further, the refrigerant introduction passage 231*c* is reduced in the passage cross-sectional area toward the axial line X side of the passage formation member 240. In this embodiment, the suction portion (suction passage) 231 is defined by the refrigerant introduction passage 231*c* and the suction passage 231*b*.

In this embodiment, the respective actuating bars 254*a* configuring the transmission member 254 are arranged at positions avoiding the refrigerant introduction passage 231*c* in the diffuser body 230 so as not to interfere with the refrigerant flowing in the refrigerant introduction passage 231*c* (not to block the flow of refrigerant).

Other structures and operations are the same as those of the first embodiment. The ejector 100 of this embodiment obtains the following advantages in addition to the advantages described in the first embodiment.

In other words, in this embodiment, the suction portion (suction passage) 231 is configured by the refrigerant introduction passage 231*c* formed to extend in a direction intersecting with the axial direction of the passage formation member 240, and to be reduced in the passage cross-sectional area toward the axial line X side of the passage formation member 240.

According to the above configuration, as compared with a case in which the suction portion (suction passage) 231 is configured by the annular suction space 231*a* as in the first embodiment, a pressure loss caused by a steep enlargement of the refrigerant passage in the suction portion (suction passage) 231 can be suppressed.

In this embodiment, the respective actuating bars 254*a* configuring the transmission member 254 are arranged at positions that do not interfere with the refrigerant flowing in the refrigerant introduction passage 231*c*. According to the above configuration, even if the diaphragm 251, the temperature sensing unit 252, and the like of the drive device 250 are arranged on an upper side of the suction portion (suction passage) 231, the respective actuating bars 254*a* can be prevented from causing the pressure loss of the refrigerant flowing in the suction portion (suction refrigerant) 231.

As described above, according to the ejector 100 of this embodiment, since the pressure loss in the ejector 100 can be suppressed, the refrigerant of the flow rate corresponding to the load of the refrigeration cycle 10 can flow, and the operation of the ejector 100 commensurate with the load of the refrigeration cycle 10 can be derived.

A modification of the fourth embodiment will be described below. In the above fourth embodiment, the example in which the refrigerant introduction passage 231*c* is defined in the interior of the diffuser body 230 has been described, but the present disclosure is not limited to the above configuration.

Figure 16:
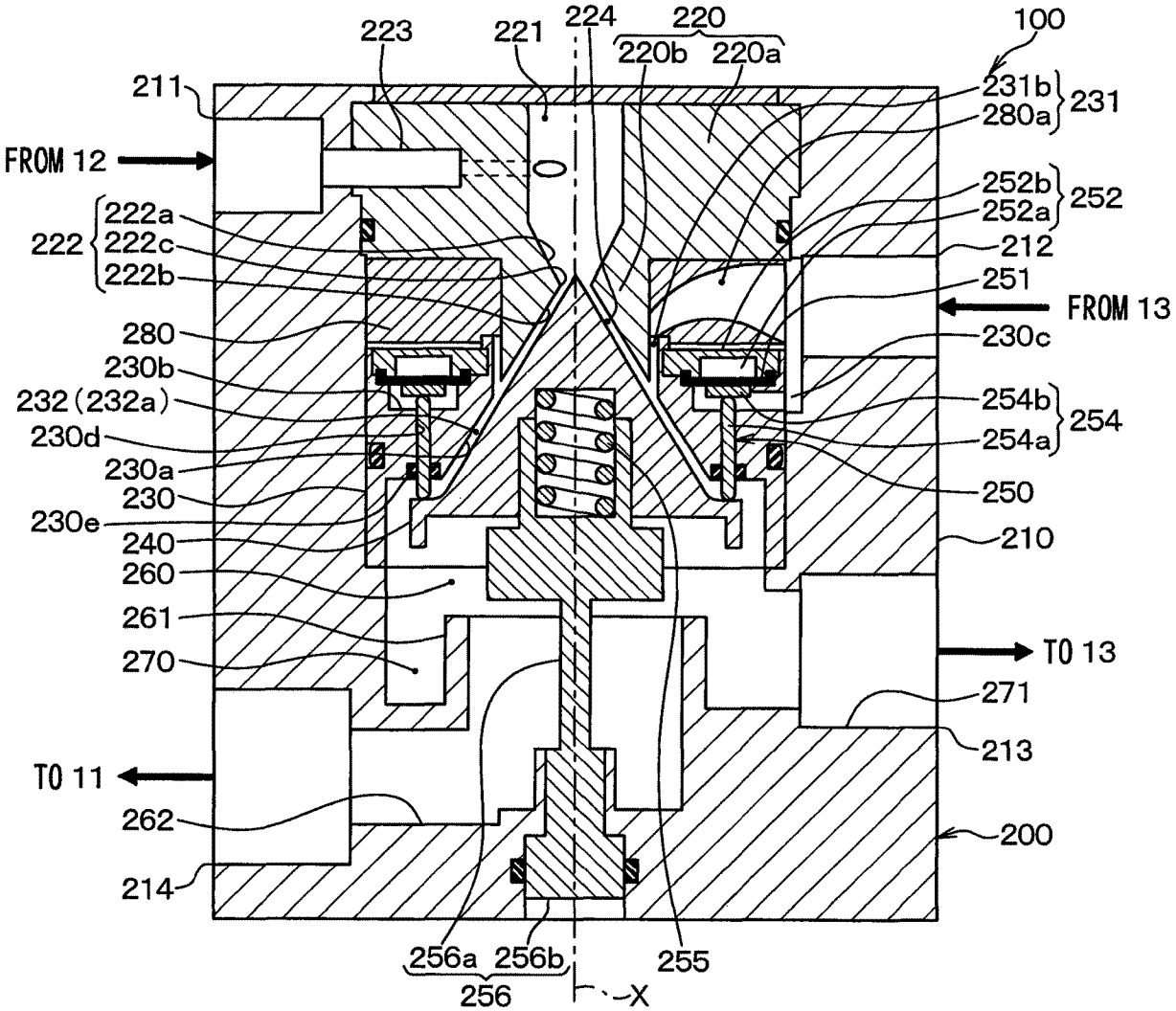
FIG. 16 is a schematic sectional view illustrating an ejector according to a modification of the fourth embodiment, taken along an axial direction of the ejector.

For example, as illustrated in FIG. 16, an annular middle body 280 may be disposed to fill the space configuring the suction space 231*a* in the first embodiment, and a refrigerant introduction passage 280*a* for introducing the refrigerant drawn from the refrigerant suction port 212 may be defined in the middle body 280. In this embodiment, the suction portion (suction passage) 231 is defined by the refrigerant introduction passage 280*a* and the suction passage 231*b*.

As with the refrigerant introduction passage 231*c* according to the fourth embodiment, the refrigerant introduction passage 280*a* may extend in a direction intersecting with the axial direction of the passage formation member 240, and be reduced in the flow channel cross-sectional area toward the axial line X side of the passage formation member 240.

The middle body 280 may be made of an annular metal member, and housed in the interior of the housing body 210 so as to overlap (overlap) with the refrigerant suction port 212 in a direction orthogonal to the axial direction (vertical direction) of the housing body 210. As in the first embodiment, the drive device 250 may be housed in the groove portion 230*b* defined in an upper part of the diffuser body 230.

According to the ejector 100 of the present modification, as in the ejector 100 according to the fourth embodiment, the pressure loss in the interior of the ejector 100 can be suppressed. Therefore, the refrigerant flow rate corresponding to the load of the refrigeration cycle 10 can flow, and the operation of the ejector 100 commensurate with the load of the refrigeration cycle 10 can be derived.

Fifth Embodiment

In this embodiment, a preferable arrangement of actuating bars 254*a* configuring a transmission member 254 in an ejector 100 will be described. In this embodiment, a description of the parts identical with or equivalent to those in the first to fourth embodiments will be omitted or simplified.

In the above respective embodiments, the number of actuating bars 254*a* is not specifically referred to. For example, in the case of employing a structure in which one or two actuating bars 254*a* are disposed, the plate member 254*b* that contacts the diaphragm 251 is supported at one or two points.

In that case, since a posture of the plate member 254*b* becomes unstable, resulting in a risk that the plate member 254*b* contacts an inner wall surface of the diffuser body 230. Since a contact of the plate member 254*b* with the inner wall surface of the diffuser body 230 leads to an increase in the frictional force when the diaphragm 251 is displaced, the displacement of the diaphragm 251 may be accurately transmitted to the passage formation member 240 through the transmission member 254.

Under the circumstances, the ejector 100 according to this embodiment is structured to dispose three or more (four in this embodiment) actuating bars 254*a* around the axial line X of the passage formation member 240 for the purpose of stabilizing the posture of the plate member 254*b*.

Figure 17:
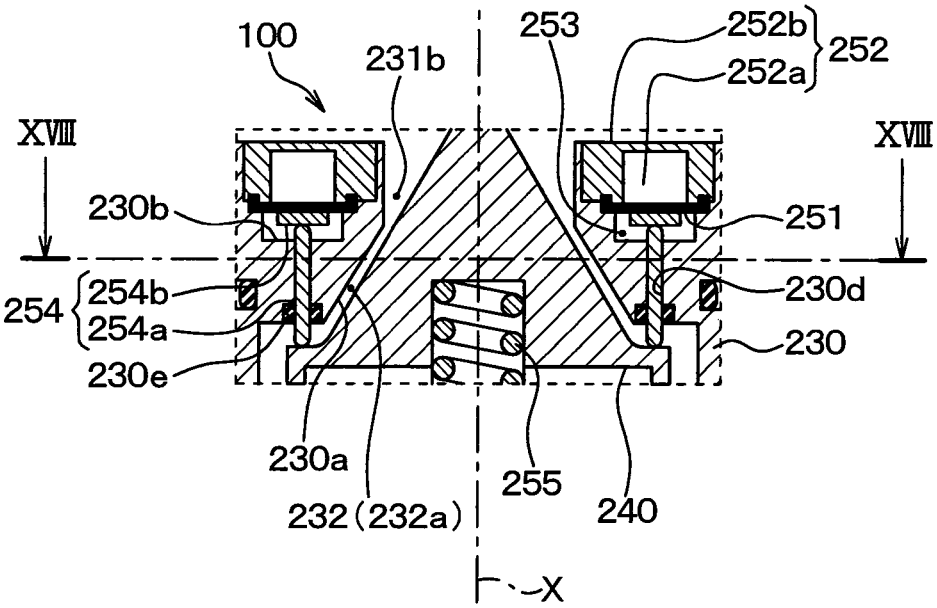
FIG. 17 is a schematic sectional view illustrating a part of an ejector according to a fifth embodiment of the present disclosure, taken along an axial direction of the ejector.

Hereinafter, a specific arrangement of the actuating bars 254*a* according to this embodiment will be described with reference to FIGS. 17 and 18. FIG. 17 is a cross-sectional view illustrating a neighborhood of the diffuser body 230 along the axial direction in the ejector 100 according to this embodiment, and FIG. 18 is a cross-sectional view of a line XVIII-XVIII in FIG. 17.

Figure 18:
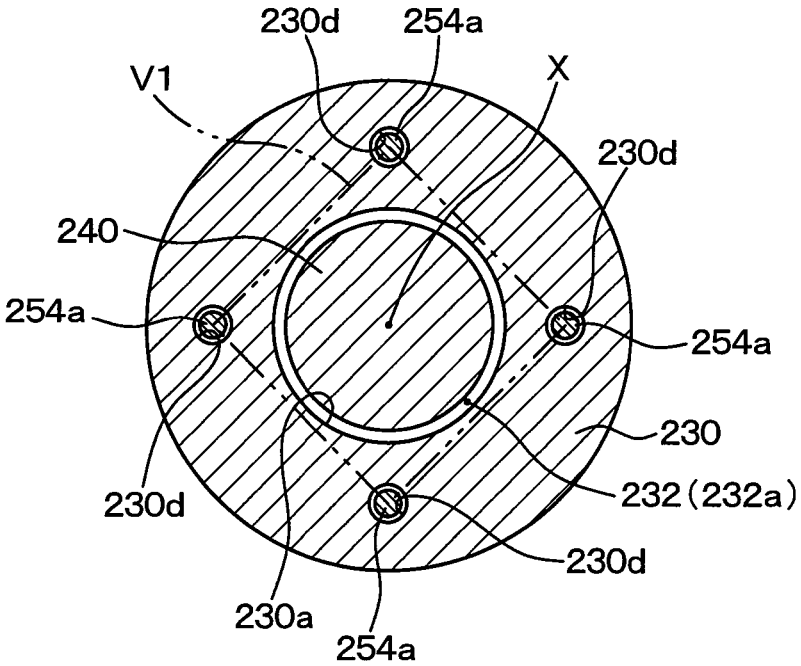
FIG. 18 is a cross-sectional view taken along a line XVIII-XVIII in FIG. 17.

As illustrated in FIGS. 17 and 18, four sliding holes 230*d* are defined at predetermined intervals (for example, about 80° to 100°) in a circumferential direction of the diffuser body 230 in the diffuser body 230 of this embodiment. Four actuating bars 254*a* are disposed in correspondence with the number of sliding holes 230*d*, and slidably arranged in the respective sliding holes 230*d*.

As illustrated in FIG. 18, the four actuating bars 254*a* are arranged around the axial line X of the passage formation member 240. In other words, the actuating bars 254*a* are arranged in such a manner that the axial line X is located within a virtual plane V1 (refer to a two-dot chain line) of a polygonal shape (rectangular shape) obtained by connecting the respective center axes of the actuating bars 254*a* with each other. The respective actuating bars 254*a* may be evenly arranged in a circumferential direction of the diffuser body 230 so that the displacement of the diaphragm 251 is accurately transmitted to the passage formation member 240.

Other structures and operations are the same as those of the above respective embodiments. The ejector 100 of this embodiment obtains the following advantages in addition to the advantages described in the respective embodiments described above. In other words, since the ejector 100 according to this embodiment has a structure in which the plate member 254*b* is supported by the actuating bars 254*a* at three or more points, the posture of the plate member 254*b* can be stabilized. For that reason, the contact of the plate member 254*b* and the inner wall surface of the diffuser body 230 caused by the inclination of the posture of the plate member 254*b* can be suppressed.

Therefore, according to the ejector 100 of this embodiment, the displacement of the diaphragm 251 can be precisely transmitted to the passage formation member 240 through the passage formation member 254, and the refrigerant flow rate can be adjusted according to the temperature and the pressure of the refrigerant in the suction portion 231.

Figure 19:
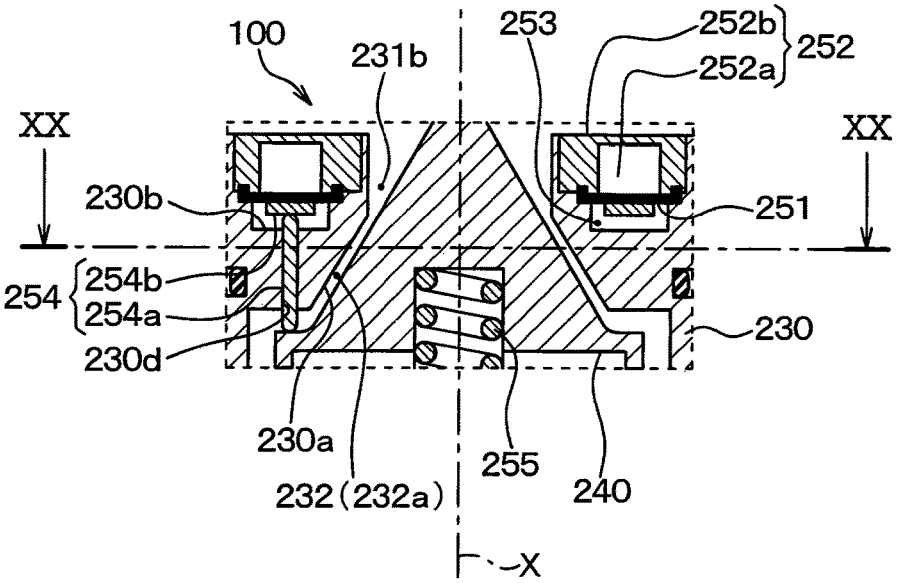
FIG. 19 is a cross-sectional view illustrating a part of an ejector according to the fifth embodiment, taken along the axial direction of the ejector.

An example of a fifth embodiment will be described below. According to the research and study of the present inventors, it is found that a structure in which three actuating bars 254*a* configuring a transmission member 254 are disposed is desired in the ejector 100. Hereinafter, the arrangement of the actuating bars 254*a* will be described with reference to FIGS. 19 and 20. FIG. 19 is a cross-sectional view illustrating a neighborhood of a diffuser body 230 along an axial direction in an ejector 100, and FIG. 20 is a cross-sectional view of a line XX-XX in FIG. 19.

Figure 20:
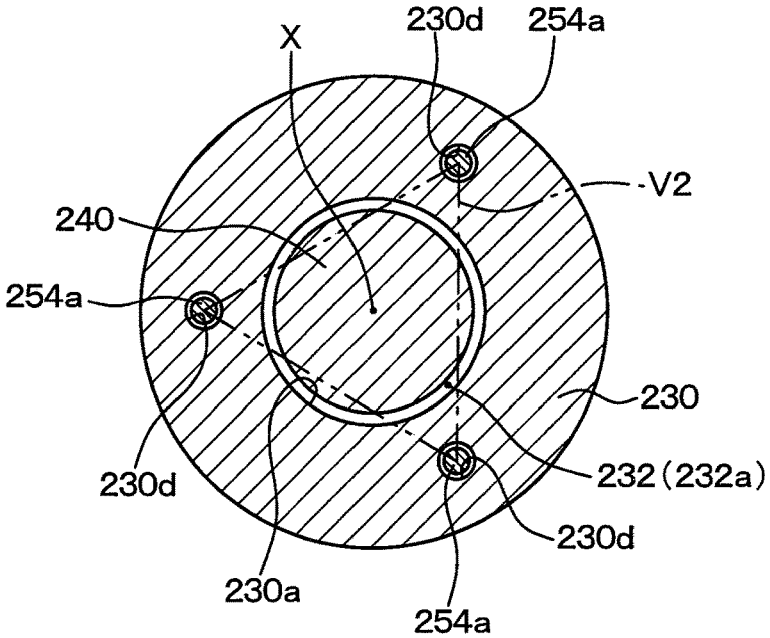
FIG. 20 is a cross-sectional view taken along a line XX-XX in FIG. 19.

As illustrated in FIGS. 19 and 20, three sliding holes 230*d* are defined at predetermined intervals (for example, about 110° to 130°) in a circumferential direction of a diffuser body 230 in the diffuser body 230 of this embodiment. The three actuating bars 254*a* are slidably arranged in the respective sliding holes 230*d*.

As illustrated in FIG. 20, the three actuating bars 254*a* are arranged around the axial line X of the passage formation member 240. In other words, the actuating bars 254*a* are arranged in such a manner that the axial line X is located within a virtual plane V2 (refer to a two-dot chain line) of a polygonal shape (triangular shape) obtained by connecting the respective center axes of the actuating bars 254*a* with each other. The respective actuating bars 254*a* may be evenly arranged in a circumferential direction of the diffuser body 230 so that the displacement of the diaphragm 251 is accurately transmitted to the passage formation member 240.

In this example, the sealing members 230*e* for suppressing the refrigerant leakage from the gaps between the actuating bars 254*a* and the sliding holes 230*d* are eliminated. In other words, in this example, the suction passage 231*b* and the diffuser passage 232*a* communicate with each other through the slight gaps defined between the actuating bars 254*a* and the sliding holes 230*d*.

Hereinafter, advantages obtained by the structure in which the three actuating bars 254*a* are arranged as in this example will be described as compared with a structure in which four or more actuating bars 254*a* are disposed. First, in the structure in which the four or more actuating bars 254*a* are disposed, if the lengths of the respective actuating bars 254*a* are varied, three of the respective actuating bars 254*a* may contact the plate member 254*b*, and the other actuating bars 254*a* may not contact the plate member 254*b*. In other words, in the structure in which the four or more actuating bars 254*a* are disposed, three of the respective actuating bars 254*a* contribute to the stabilization of the posture of the plate member 254*b*, and the other actuating bars 254*a* may not contribute to the stabilization of the posture of the plate member 254*b*.

On the contrary, in the structure in which the three actuating bars 254*a* are disposed, even if the lengths of the respective actuating bars 254*a* are varied, the respective actuating bars 254*a* contact the plate member 254*b*, and contribute to the stabilization of the posture of the plate member 254*b*.

A part of the respective actuating bars 254*a* is located on a downstream side of the diffuser passage 232*a*, and the actuating bars 254*a* per se cause a flow resistance to the refrigerant drawn from the suction passage 231*b* into the diffuser passage 232*a*. The flow resistance to the refrigerant drawn from the suction passage 231*b* into the diffuser passage 232*a* increases with an increase in the number of actuating bars 254*a*.

On the contrary, in the structure in which the three actuating bars 254*a* are disposed, the flow resistance of the refrigerant drawn from the suction passage 231*b* can be suppressed as compared with the structure in which the four or more actuating bars 254*a* are arranged, while stabilizing the posture of the plate member 254*b*. As a result, the refrigerant flow rate drawn from the suction passage 231*b* can be ensured, and the performance of the ejector 100 can be improved (the ejector efficiency is improved). An ejector efficiency $\eta e$ is defined by the following Formula F1.

$$\eta e=(1+Ge/Gnoz)\times(\Delta P/\rho)/\Delta i \quad \text{(F1)}$$

where "Ge" is a flow rate of the refrigerant drawn into the suction portion 231, "Gnoz" is a flow rate of the refrigerant jetted from the nozzle passage 224, and "ΔP" is a pressure increase amount in the diffuser passage 232*a*. "ρ" is a density of the refrigerant drawn into the suction portion 231, and "Δi" is an actual enthalpy difference of the refrigerant between an inlet and an outlet of the nozzle passage 224.

The gaps between the actuating bars 254*a* and the sliding holes 230*d* are detours that allow the refrigerant in the suction passage 231*b* to bypass the diffuser passage 232*a*, and flow to the downstream side of the diffuser passage 232*a*. As the number of sliding holes 230*d* in which the actuating bars 254*a* slide increases more, the area of the gaps between the actuating bars 254*a* and the sliding holes 230*d* becomes larger, and a refrigerant leakage amount from the gaps increases. An increase in the refrigerant leakage amount leads to a reduction in the refrigerant flow rate flowing in the diffuser passage 232*a*, and therefore is not preferable.

On the contrary, in the structure in which the three actuating bars 254*a* are disposed, since only three sliding holes 230*d* are provided, the area of the gaps between the sliding holes 230*d* and the actuating bars 254*a* can be reduced as compared with the structure in which the four or more actuating bars 254*a* are disposed. For that reason, in the structure in which the three actuating bars 254*a* are disposed, the refrigerant leakage is reduced, and the refrigerant of the suction passage 231*b* can be properly led to the diffuser passage 232*a* as compared with the structure in which the four or more actuating bars 254*a* are disposed. As a result, since the refrigerant drawn from the suction passage 231*b* can be properly pressurized in the diffuser passage 232*a*, the performance of the ejector 100 can be improved (the ejector efficiency is improved) (refer to Formula F1).

In the structure in which the four or more actuating bars 254*a* are arranged, there is a need to dispose the sealing members 230*e* for suppressing the refrigerant leakage from the gaps between the actuating bars 254*a* and the sliding holes 230*d*. The refrigerant leakage from the gaps between the actuating bars 254*a* and the sliding holes 230*d* can be suppressed by the sealing members 230*e*. On the other hand, the sliding resistance of the actuating bars 254*a* is increased by the sealing members 230*e*. An increase in the sliding resistance of the actuating bars 254*a* as described above prevents the displacement of the diaphragm 251 from being accurately transmitted to the passage formation member 240, and makes it difficult to adjust the refrigerant flow rate according to the temperature and the pressure of the refrigerant in the suction passage 231*b*. Therefore, such an increase in the sliding resistance of the actuating bars 254*a* is not preferable.

On the contrary, in the structure in which the three actuating bars 254*a* are disposed, as described above, since the refrigerant leakage from the gaps between the actuating bars 254*a* and the sliding holes 230*d* can be suppressed, the sealing members 230*e* that produce the sliding resistance of the actuating bars 254*a* can be eliminated. If the sealing members 230*e* are eliminated in the structure in which the three actuating bars 254*a* are disposed, the displacement of the diaphragm 251 can be properly transmitted to the passage formation member 240 while suppressing the sliding resistance of the actuating bars 254*a*. In other words, when the sealing members 230*e* are eliminated in the structure in which the three actuating bars 254*a* are disposed, the refrigerant flow rate can be adjusted according to the temperature and the pressure of the refrigerant in the suction passage 231*b* while suppressing the refrigerant leakage from the gaps between the actuating bars 254*a* and the sliding holes 230*d*.

As described above, in the structure in which the three actuating bars 254*a* are disposed, as described above, as compared with the structure in which the four or more actuating bars 254*a* are arranged, the performance of the ejector 100 can be improved, and the refrigerant flow rate can be adjusted according to the temperature and the pressure of the refrigerant in the suction passage 231*b*.

As described above, the sealing members 230*e* for suppressing the refrigerant leakage from the gaps between the actuating bars 254*a* and the sliding holes 230*d* may be eliminated, but without being limited to this configuration, the sealing members 230*e* may be disposed in the gaps between the actuating bars 254*a* and the sliding holes 230*d*.

The embodiments of the present disclosure have been described above. However, the present disclosure is not limited to the above-described embodiments, and can be appropriately modified within the scope described in the appended claims. For example, the aforementioned embodiments can be variously modified as described below.

(1) In the above respective embodiments, the passage formation member 240 is shaped in an isosceles triangle in a cross-section along the axial direction, but the present disclosure is not limited to the above shape. The passage formation member 240 may have a shape in which two sides between which a vertex is sandwiched are convexed toward an inner peripheral side, or a shape in which the two sides are convexed toward an outer peripheral side in a cross-section along the axial direction, or a semicircular shape in cross-section.

(2) In the above respective embodiments, the example in which the plate member 254*b* of the transmission member 254 is annularly shaped as with the diaphragm 251, but the present disclosure is not limited to the above example. For example, the plate member 254*b* may be configured by a member obtained by dividing an annular metal member into multiple pieces in the circumferential direction. Even with the above configuration, a force to be transmitted to the actuating bars 254*a* from the diaphragm 251 can be restrained from being changed due to the warp of the diaphragm 251 or the variation in the pressure of the temperature sensitive medium.

(3) In order to properly transmit the displacement of the diaphragm 251 to the passage formation member 240, the multiple actuating bars 254*a* configuring the transmission member 254 may be arranged as in the above respective embodiments, but not limited to this configuration. The displacement of the diaphragm 251 may be properly transmitted to the passage formation member 240 by one actuating bar 254*a*.

(4) As described in the above respective embodiments, the diaphragm 251 may be configured by the rubber base material 251*a*, but the present disclosure is not limited to this configuration. For example, the diaphragm 251 may be made of stainless steel. The pressure responsive member is not limited to the diaphragm 251, but may be configured by a movable part such as a piston which is displaced according to the internal pressure of the sealed space 252*a*.

(5) As in the above embodiments, the coil spring 255 or the load adjusting member 256 may be added to the drive device 250, but the coil spring 255 and the load adjusting member 256 are not essential, and may be omitted.

(6) As in the above embodiments, the gas-liquid separation space 260 or the reservoir space 270 may be disposed in the interior of the ejector 100, but without being limited to the above configuration, a gas-liquid separator or a reservoir may be disposed outside of the ejector 100.

(7) In the above embodiments, the example in which the swirling space 221 is defined in the nozzle body 220 has been described. However, without being limited to the above configuration, for example, the swirling space 221 may be defined in the housing body 210.

(8) In the above embodiments, the example in which most of the components configuring the body 200, the passage formation member 240, the drive device 250, and so on are formed of metal members has been described, but the present disclosure is not limited to the above example. The respective components may be configured by members other than the metal member (for example, resin) to the extent that the pressure resistance and the heat resistance are not problematic.

(9) In the above embodiments, the example in which the subcooling condenser is employed as the condenser 12 has been described. However, without being limited to the above configuration, for example, a condenser in which the receiver 12*b* and the subcooling portion 12*c* are not provided may be employed.

(10) In the above embodiments, the example in which the ejector 100 of the present disclosure is applied to the refrigeration cycle 10 of the vehicle air conditioning apparatus has been described. However, without being limited to this example, the ejector 100 according to the present disclosure may be applied to, for example, a heat pump cycle used in a stationary air conditioning apparatus.

(11) In the above-described respective embodiments, elements configuring the embodiments are not necessarily indispensable as a matter of course, except when the elements are particularly specified as indispensable and the elements are considered as obviously indispensable in principle.

(12) In the above-described respective embodiments, when numerical values such as the number, figures, quantity, a range of configuration elements in the embodiments are described, the numerical values are not limited to a specific number, except when the elements are particularly specified as indispensable and the numerical values are obviously limited to the specific number in principle.

(13) In the above-described respective embodiments, when a shape and a positional relationship of the configuration elements are described, the configuration elements are not limited to the shape and the positional relationship, except when the configuration elements are particularly specified and are limited to a specific shape and a positional relationship in principle.

The invention claimed is:

1. An ejector for a vapor compression refrigeration cycle, comprising:

a body including a refrigerant inlet port through which a refrigerant is introduced, a swirling space in which the refrigerant flowing from the refrigerant inlet port is swirled, a depressurizing space in which the refrigerant flowing out of the swirling space is depressurized, a suction passage that communicates with a downstream side of the depressurizing space in a refrigerant flow and draws a refrigerant from an external, and a pressurizing space in which an ejection refrigerant ejected from the depressurizing space and a suction refrigerant drawn through the suction passage are mixed with each other and pressurized;

a passage formation member which is arranged at least in the depressurizing space and the pressurizing space and has a shape that increases in cross-sectional area with distance from the depressurizing space; and a drive device that displaces the passage formation member, wherein the depressurizing space has a nozzle passage, which functions as a nozzle that depressurizes and ejects the refrigerant that has flowed out of the swirling space, between an inner peripheral surface of the body and an outer peripheral surface of the passage formation member, the pressurizing space has a diffuser passage, which functions as a diffuser that mixes and pressurizes the ejection refrigerant and the suction refrigerant together, between the inner peripheral surface of the body and the outer peripheral surface of the passage formation member, the drive device includes a temperature sensing unit in which a temperature sensitive medium that changes in pressure according to temperature change is sealed, and a pressure responsive member that is displaced according to a pressure of the temperature sensitive medium in the temperature sensing unit, the drive device is housed in the body in a state where a heat of the suction refrigerant in the suction passage is transferred to the temperature sensitive medium in the temperature sensing unit through the temperature sensing unit, and the temperature sensing unit and the pressure responsive member each have an annular shape surrounding an axial line of the passage formation member.

2. The ejector according to claim 1, wherein the drive device includes a transmission member that transmits a displacement of the pressure responsive member to the passage formation member, the transmission member includes at least one actuating bar having one end being in contact with the passage formation member, and a plate member being in contact with both another end of the actuating bar and the pressure responsive member, and the plate member is higher in rigidity than the pressure responsive member.

3. The ejector according to claim 2, wherein the number of the at least one actuating bar is three or four, and the three or four actuating bars are arranged to surround the axial line of the passage formation member.

4. The ejector according to claim 3, wherein the body further includes three sliding holes that extend in a direction of the axial line of the passage formation member, and the suction passage communicates with a downstream side of the diffuser passage, the three sliding holes are arranged at intervals in a circumferential direction of the passage formation member, the number of the at least one actuating bar is three, and the three actuating bars are arranged, respectively, in the three sliding holes in a slidable manner.

5. The ejector according to claim 2, wherein the plate member has an annular shape overlapping with the pressure responsive member in an axial direction of the passage formation member.

6. The ejector according to claim 2, wherein the pressure responsive member is a diaphragm having a rubber base material with an annular shape.

7. The ejector according to claim 6, wherein the diaphragm has a barrier film made of a material lower in gas permeability than the base material.

8. The ejector according to claim 2, wherein the drive device has a coupling member that couples the temperature sensing unit with the pressure responsive member, the temperature sensing unit, the pressure responsive member, the transmission member, and the coupling member configure a single drive unit, and the single drive unit is a member separated from the body.

9. The ejector according to claim 2, wherein at least one of a portion of the actuating bar which contacts the passage formation member and a portion of the actuating bar which contacts the plate member is configured to be changeable in contact position and contact angle with respect to the corresponding member.

10. The ejector according to claim 9, wherein at least one of the portion of the actuating bar which contacts the passage formation member and the portion of the actuating bar which contacts the plate member has a curved shape.

11. The ejector according to claim 1, wherein the temperature sensing unit has a temperature sensitive cylinder that is disposed in the suction passage and exposed to the suction refrigerant in the suction passage.

12. The ejector according to claim 11, wherein the body further includes a refrigerant suction port from which the refrigerant is introduced into the suction passage, and the temperature sensitive cylinder is disposed at a position closer to the refrigerant suction port than the axial line of the passage formation member.

13. The ejector according to claim 1, wherein the temperature sensing unit includes a heat transfer portion which transmits a temperature of the suction refrigerant in the suction passage to the temperature sensitive medium, and a portion other than the heat transfer portion, and the portion other than the heat transfer portion is higher in thermal resistance than the heat transfer portion.

14. The ejector according to claim 1, wherein the drive device is disposed at a position other than a flow of the suction refrigerant in the suction passage in the body.

15. The ejector according to claim 1, wherein the suction passage extends in a direction intersecting with the axial line of the passage formation member and reduces in passage cross-sectional area toward the axial line of the passage formation member.

* * * * *